US006645925B2

(12) United States Patent
Sivik et al.

(10) Patent No.: US 6,645,925 B2
(45) Date of Patent: Nov. 11, 2003

(54) LIQUID DETERGENT COMPOSITIONS COMPRISING QUATERNARY NITROGEN-CONTAINING AND/OR ZWITTERIONIC POLYMERIC SUDS ENHANCERS

(75) Inventors: Mark Robert Sivik, Mason, OH (US); Jean-Francois Bodet, Mason, OH (US); Bernard William Kluesener, Harrison, OH (US); William Michael Scheper, Lawrenceburg, IN (US); Dominic Wai-Kwing Yeung, Mississauga (CA); Vance Bergeron, Antony (FR)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/037,383

(22) Filed: Jan. 4, 2002

(65) Prior Publication Data

US 2003/0134770 A1 Jul. 17, 2003

(Under 37 CFR 1.47)

Related U.S. Application Data

(60) Provisional application No. 60/259,962, filed on Jan. 5, 2001.

(51) Int. Cl.[7] ..... C11D 1/00; C11D 3/20; C11D 3/26; C11D 3/37

(52) U.S. Cl. ..... 510/237; 510/499; 510/501; 510/504; 510/505

(58) Field of Search ..... 510/237, 499, 510/501, 504, 505

(56) References Cited

U.S. PATENT DOCUMENTS 4,622,378 A * 11/1986 Gosselink ..... 528/66
4,661,288 A * 4/1987 Rubingh et al. ..... 252/545
4,814,101 A * 3/1989 Schieferstein et al. . 252/174.23
5,863,880 A * 1/1999 Shih et al. ..... 510/361
6,525,012 B2 * 2/2003 Price et al. ..... 510/321
2003/0087794 A1 * 5/2003 Price et al. ..... 510/499

OTHER PUBLICATIONS

U.S. patent application Ser. No. 10/038,373, Sivik et al., filed Jan. 4, 2002.
U.S. patent application Ser. No. 09/699,547, Bodet et al., filed Oct. 30, 2000.
U.S. patent application Ser. No. 09/702,083, Sivik et al., filed Oct. 30, 2000.
U.S. patent application Ser. No. 09/702,084, Sivik et al., filed Oct. 30, 2000.
U.S. patent application Ser. No. 09/699,522, Sivik et al., filed Oct. 30, 2000.

* cited by examiner

*Primary Examiner*—Gregory Delcotto
(74) *Attorney, Agent, or Firm*—Caroline Wei-Berk; Kim W. Zerby; Steve W. Miller

(57) ABSTRACT

Liquid detergent compositions comprising a polymeric material which is a suds enhancer and a suds volume extender, said compositions having increased effectiveness for preventing re-deposition of grease during hand washing are provided. The polymeric material which are suitable as suds volume and suds endurance enhancers comprise an effective amount of a quaternary nitrogen-containing monomeric unit and/or zwitterionic monomeric unit-containing polymeric suds enhancer comprise:

i) units capable of having a cationic charge at a pH of from about 4 to about 12;

provided that said suds enhancer has an average cationic charge density of 2.8 or less units per 100 daltons molecular weight at a pH of from about 4 to about 12;

b) an effective amount of a detersive surfactant; and c) the balance carriers and other adjunct ingredients;

provided that a 10% aqueous solution of said detergent composition has a pH of from about 4 to about 12.

22 Claims, No Drawings

LIQUID DETERGENT COMPOSITIONS COMPRISING QUATERNARY NITROGEN-CONTAINING AND/OR ZWITTERIONIC POLYMERIC SUDS ENHANCERS

RELATED APPLICATIONS

This application claims priority under 35 U.S.C. §119(e) to U.S. Provisional Application No. 60/259,962, filed Jan. 5, 2001.

FIELD OF THE INVENTION

The present invention relates to liquid detergent compositions suitable for hand dishwashing comprising a polymeric suds volume and suds duration enhancer wherein the polymeric suds volume and suds duration enhancer comprises one or more quaternary nitrogen-containing monomeric units and/or zwitterionic monomeric units. The polymeric suds enhancers (suds boosters) suitable for use in the compositions of the present invention comprise have an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12. The present invention further relates to methods for providing enhanced suds volume and suds duration during hand washing.

BACKGROUND OF THE INVENTION

Liquid detergent compositions which are suitable for hand dishwashing must satisfy several criteria in order to be effective. These compositions must be effective in cutting grease and greasy food material and once removed, must keep the greasy material from re-depositing on the dishware.

The presence of suds in a hand dishwashing operation has long been used as a signal that the detergent continues to be effective. However, depending upon the circumstances, the presence of suds or the lack thereof, has no bearing upon the efficacy of liquid detergents. Therefore, the consumer has come to rely upon a somewhat erroneous signal, the lack or absence of soap suds, to indicate the need for additional detergent. In many instances the consumer is adding an additional amount of detergent far in excess of the amount necessary to thoroughly clean the dishes. This wasteful use of detergent is especially true in hand dishwashing since the soiled cooking articles are usually cleaned in a "washing difficulty" queue, for example, glasses and cups, which usually do not contact greasy food, are washed first, followed by plates and flatware, and finally pots and pans which contain the most residual food material and are usually, therefore, the "greasiest".

The lack of suds in the dishwater when pots and pans are usually cleaned, together with the visual inspection of the amount of residual food material on the cookware surface, typically compels the consumer to add additional detergent when a sufficient amount still remains in solution to effectively remove the soil and grease from the dishware or cookware surface. However, effective grease cutting materials do not necessarily produce a substantial amount of corresponding suds.

Accordingly, there remains a need in the art for liquid dishwashing detergents useful for hand washing dishware which have an enduring suds level while maintaining effective grease cutting properties. The need exists for a composition which can maintain a high level of suds as long as the dishwashing composition is effective. Indeed, there is a long felt need to provide a hand dishwashing composition which can be use efficiently by the consumer such that the consumer uses only the necessary amount of detergent to fully accomplish the cleaning task.

SUMMARY OF THE INVENTION

The present invention meets the aforementioned needs in that it has been surprisingly discovered that polymeric materials comprising one or more quaternary nitrogen-containing monomeric units and/or zwitterionic monomeric units have the capacity to provide liquid hand wash detergent compositions with extended suds volume and suds duration benefits. In other words, such polymeric materials are polymeric suds enhancers (suds boosters).

In one aspect of the present invention, liquid detergent compositions having increased suds volume and suds retention suitable for use in hand dishwashing, said compositions comprising:

a) an effective amount of polymeric suds enhancer (suds booster) wherein the polymeric suds enhancer comprises one or more quaternary nitrogen-containing monomeric units and/or zwitterionic monomeric units, preferably wherein said stabilizer comprises:
   i) units capable of having a cationic charge at a pH of from about 4 to about 12;
      provided that said suds enhancer has an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12;

b) an effective amount of a detersive surfactant; and c) the balance carriers and other adjunct ingredients;

provided that a 10% aqueous solution of said detergent composition has a pH of from about 4 to about 12, is provided.

In another aspect of the present invention, liquid detergent compositions having increased suds volume and suds retention suitable for use in hand dishwashing, said compositions comprising:

a) an effective amount of polymeric suds enhancer (suds booster) wherein the polymeric suds enhancer comprises one or more quaternary nitrogen-containing monomeric units and/or zwitterionic monomeric units, preferably wherein said stabilizer comprises:
   i) one or more units capable of having a cationic charge at a pH of from about 4 to about 12; and
   ii) one or more units having one or more hydroxyl groups;
      provided that said suds enhancer has a hydroxyl group density of about 0.5 or less, preferably from about 0.0001 to about 0.4; and
   iii) optionally, one or more other monomeric units described hereinafter;
      provided that said suds enhancer has an average cationic charge density of 2.8 or less; and b) an effective amount of a detersive surfactant; and c) the balance carriers and other adjunct ingredients;

provided that a 10% aqueous solution of said detergent composition has a pH of from about 4 to about 12, is provided.

In yet another aspect of the present invention, liquid detergent compositions having increased suds volume and suds retention suitable for use in hand dishwashing, said compositions comprising:

a) an effective amount of polymeric suds enhancer (suds booster) wherein the polymeric suds enhancer comprises one or more quaternary nitrogen-containing monomeric units and/or zwitterionic monomeric units, preferably wherein said stabilizer comprises:
   i) one or more units capable of having a cationic charge at a pH of from about 4 to about 12; and
   ii) one or more units having one or more hydrophobic groups, preferably the hydrophobic groups are selected from the group consisting of non-hydroxyl groups, non-cationic groups, non-anionic groups, non-carbonyl groups, and/or non-H-bonding group, more preferably the hydrophobic groups are selected from the group consisting of alkyls, cycloalkyls, aryls, alkaryls, aralkyls and mixtures thereof;
   iii) optionally, one or more other monomeric units described hereinafter;
   provided that said suds enhancer has an average cationic charge density of 2.8 or less;

b) an effective amount of a detersive surfactant; and c) the balance carriers and other adjunct ingredients;

provided that a 10% aqueous solution of said detergent composition has a pH of from about 4 to about 12, is provided.

In still another aspect of the present invention, methods for providing increased suds retention and suds volume when hand washing dishware is provided.

These and other objects, features and advantages will become apparent to those of ordinary skill in the art from a reading of the following detailed description and the appended claims.

All percentages, ratios and proportions herein are by weight, unless otherwise specified. All temperatures are in degrees Celsius (° C.) unless otherwise specified. All documents cited are in relevant part, incorporated herein by reference.

Additional background on these compositions and methods is provided by PCT patent application Ser. Nos. PCT/US98/24853, PCT/US98/24707, PCT/US98/24699 and/or PCT/US98/24852 all incorporated herein by reference in their entirety.

All substituent groups in structural formulas in the Specification and Claims have the meaning defined in previous structural formulas in the Specification or Claims, respectively, unless indicated otherwise.

DETAILED DESCRIPTION OF THE INVENTION

Definitions

"Polymeric suds enhancers (suds boosters)"—"Polymeric suds enhancers (suds boosters)" as used herein means polymeric materials comprising one or more quaternary nitrogen-containing monomeric units which are cationic monomeric units and/or zwitterionic monomeric units. The different types of polymeric materials which fall within this definition are set forth below:

1) polymeric materials comprising cationic monomeric units (i.e., quaternary nitrogen-containing monomeric units alone or in combination with other cationic monomeric units);
2) polymeric materials comprising cationic and nonionic monomeric units (i.e., quaternary nitrogen-containing monomeric units alone or in combination with other cationic monomeric units, plus one or more nonionic monomeric units);
3) polymeric materials comprising cationic and anionic monomeric units (i.e., quaternary nitrogen-containing monomeric units alone or in combination with other cationic monomeric units, plus one or more anionic monomeric units);
4) polymeric materials comprising cationic, nonionic and anionic monomeric units (i.e., quaternary nitrogen-containing monomeric units alone or in combination with other cationic monomeric units, plus one or more nonionic monomeric units and one or more anionic monomeric units);
5) polymeric materials comprising zwitterionic monomeric units (i.e., zwitterionic monomeric units alone);
6) polymeric materials comprising zwitterionic and cationic monomeric units (i.e., zwitterionic monomeric units, plus one or more cationic monomeric units);
7) polymeric materials comprising zwitterionic and nonionic monomeric units (i.e., zwitterionic monomeric units, plus one or more nonionic monomeric units);
8) polymeric materials comprising zwitterionic and anionic monomeric units (i.e., zwitterionic monomeric units, plus one or more anionic monomeric units);
9) polymeric materials comprising zwitterionic, cationic and nonionic monomeric units (i.e., zwitterionic monomeric units, plus one or more cationic monomeric units and one or more nonionic monomeric units);
10) polymeric materials comprising zwitterionic, cationic and anionic monomeric units (i.e., zwitterionic monomeric units, plus one or more cationic monomeric units and one or more anionic monomeric units);
11) polymeric materials comprising zwitterionic, nonionic and anionic monomeric units (i.e., zwitterionic monomeric units, plus one or more nonionic monomeric units and one or more anionic monomeric units);
12) polymeric materials comprising zwitterionic, cationic, nonionic and anionic monomeric units (i.e., zwitterionic monomeric units, plus one or more cationic monomeric units, one or more nonionic monomeric units and one or more anionic monomeric units).

"Effective amount of a polymeric suds enhancer (suds booster)"—An "effective amount of a polymeric suds enhancer (suds booster)" as used herein means a sufficient amount of the polymeric suds enhancer such that greasy and/or composite soils are removed and/or reduced from a substrate coming into contact with the polymeric suds enhancer.

The present invention relates to polymeric materials which provide enhanced suds duration and enhanced suds volume when formulated into liquid detergent compositions suitable for hand dishwashing. The polymeric material comprises one or more quaternary nitrogen-containing monomeric units and/or zwitterionic monomeric units, preferably wherein said polymeric material comprises an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12.

The liquid detergent compositions of the present invention comprise:

a) an effective amount of polymeric suds enhancer (suds booster) wherein the polymeric suds enhancer comprises one or more quaternary nitrogen-containing monomeric units and/or zwitterionic monomeric units, preferably wherein said stabilizer comprises:

i) units capable of having a cationic charge at a pH of from about 4 to about 12;

provided that said suds enhancer has an average cationic charge density preferably from about 0.01 to about 2.8, more preferably from about 0.1 to about 2.75, most preferably from about 0.75 to about 2.25 units per 100 daltons molecular weight at a pH of from about 4 to about 12;

b) an effective amount of a detersive surfactant; and c) the balance carriers and other adjunct ingredients;

provided that a 10% aqueous solution of said detergent composition has a pH of from about 4 to about 12.

It is preferred that the polymeric suds enhancer (a) preferably further comprises one or more of the following:

ii) one or more units having one or more hydroxyl groups, provided that the polymeric suds enhancer has a hydroxyl group density of about 0.5 or less, preferably from about 0.0001 to about 0.4 as measured by the Hydroxyl Group Density Equation as outlined in greater detail below; and/or iii) one or more units having one or more hydrophobic groups, preferably the hydrophobic groups are selected from the group consisting of non-hydroxyl groups, non-cationic groups, non-anionic groups, non-carbonyl groups, and/or non-H-bonding group, more preferably the hydrophobic groups are selected from the group consisting of alkyls, cycloalkyls, aryls, alkaryls, aralkyls and mixtures thereof.

It is desirable that the polymeric suds enhancer (a) further optionally, but preferably comprises one or more of the following:

iv) units capable of having an anionic charge at a pH of from about 4 to about 12;

v) units capable of having an anionic charge and a cationic charge at a pH of from about 4 to about 12;

vi) units having no charge at a pH of from about 4 to about 12; and vii) mixtures of units (iv), (v), (vi), and (vii).

The following describe non-limiting examples of polymeric material which may be suitable for use in the liquid detergent compositions of the present invention.

Polymeric Suds Enhancers (Suds Boosters)

The polymeric suds enhancers of the present invention are polymers which contain one or more quaternary nitrogen-containing monomeric units and/or zwitterionic monomeric units, and preferably further contain units capable of having a cationic charge at a pH of from about 4 to about 12, provided that the suds enhancer has an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12.

Preferably, the polymeric suds enhancers also include units capable of influencing the average cationic charge density of the quaternary nitrogen-containing or zwitterionic polymeric suds enhancers, preferably by decreasing the average cationic charge density of the quaternary nitrogen-containing or zwitterionic polymeric suds enhancers. Such units capable of influencing the average cationic charge density of the polymeric suds enhancers may, and preferably do, provide additional advantageous properties to the polymeric suds enhancers that increase their cleaning and/or suds boosting and/or suds retention properties. Further, such units may increase the interactions between the polymer, which is neutral or positively charged, and the soil which is negatively charged.

Additionally, the polymeric suds enhancer can be present as the free base or as a salt. Typical counter ions include, acetate, citrate, maleate, sulfate, chloride, etc.

Further, the polymeric suds enhancers of the present invention may be copolymers, terpolymers with random and/or repeating units, and/or block polymers such as di-, tri- and multi-block polymers.

For example a copolymer can be made from two monomers, G and H, such that G and H are randomly distributed in the copolymer, such as GHGGHGGGGGHHG . . . etc.

or G and H can be in repeating distributions in the copolymer, for example

GHGHGHGHGHGHGH . . . etc., or

GGGGGHHGGGGGHH . . . etc.,

The same is true of the terpolymer, the distribution of the three monomers can be either random or repeating.

The polymeric suds enhancers (suds boosters) of the present invention preferably have a molecular weight in the range of from about 1,000 to about 2,000,000, preferably from about 5,000 to about 1,000,000, more preferably from about 10,000 to about 750,000, more preferably from about 10,000 to about 500,000, even more preferably from about 15,000 to about 300,000 daltons. Most preferably, the molecular weight of the polymeric suds enhancers is about 50,000 daltons or less.

The molecular weight of the polymeric suds enhancers of the present invention are determined using a Gel Filtration Chromatography (GFC) Method. Under this GFC Method, polymers are separated using GFC columns to determine molecular weight distribution. The molecular weight and distributions are measured through separation of the polymer species based on their hydrodynamic volumes. The hydrodynamic volume is related to molecular weight.

A detailed example of how the molecular weights of the polymeric suds enhancers of the present invention are determined follows. A 0.2% solution of the polymeric suds enhancer is first prepared in the aqueous mobile phase, 80/20 0.5M Ammonium Acetate/Methanol at pH 3.7. The solution is then injected onto the GFC column at 60° C. and its absolute molecular weight and molecular weight distribution are calculated using both multi-angle laser light scattering (MALLS) and refractive index (RI) detection. Theoretical and practical examples of molecular weights determined by the GFC Method are found in: W. W. Yau, J. J. Kirkland, and D. D. Bly, *Modern Size-Exclusion Liquid Chromatography*, John Wiley & Sons, New York, 1979.

Quaternary Nitrogen-Containing Monomeric Units

Any suitable quaternary nitrogen-containing group can be used as a monomeric unit of the polymeric suds enhancers of the present invention.

Nonlimiting examples of quaternary nitrogen-containing monomeric units suitable for the polymeric suds enhancers of the present invention include:

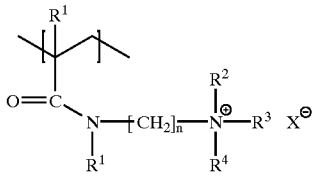

wherein $R^1$ is a hydrogen or a methyl group, preferably a methyl group; $R^2$, $R^3$ and $R^4$ are linear or branched $C_1$–$C_4$ alkyl groups, preferably $C_1$ groups; n represents an integer from 1 to 4, preferably 3; and $X^-$ represents a counterion which is compatible with the water-soluble or water-dispersible nature of the polymer, preferably $Cl^-$;

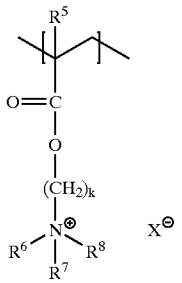

wherein $R^5$, $R^6$, $R^7$ and $R^8$ are independently H, or a $C_1$–$C_4$ alkyl group, preferably a methyl group; k is an integer from 1 to 4, preferably 2; and $X^-$ represents a counterion which is compatible with the water-soluble or water-dispersible nature of the polymer, preferably $Cl^-$; and

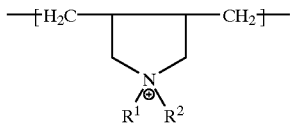

wherein $R^1$ and $R^2$ are independently H or a $C_1$–$C_4$ alkyl group, preferably a methyl group.

Zwitterionic Units

Any suitable zwitterionic group can be used as a monomeric unit of the suds enhancers of the present invention.

Nonlimiting examples of zwitterionic monomeric units suitable for the suds enhancers of the present invention include:

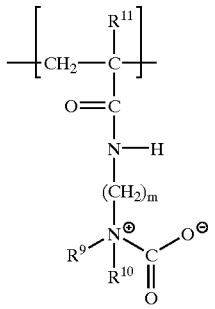

wherein $R^9$, $R^{10}$ and $R^{11}$ are independently H, or a $C_1$–$C_4$ alkyl group, preferably a methyl group; and m is an integer from 1 to 4, preferably 2.

Nonlimiting examples of zwitterionic monomeric units in accordance with the present invention include:

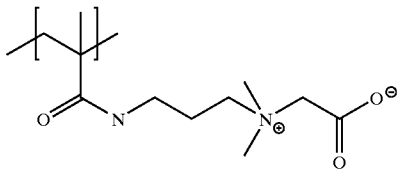

Other Monomers

In addition to the quaternary nitrogen-containing monomeric units and/or the zwitterionic monomeric units, the suds enhancers of the present invention may, and preferably do include one or more other monomeric units, other than quaternary nitrogen-containing monomeric units and zwitterionic monomeric units, such as amine oxide monomeric units, other cationic monomeric units, hydroxyl-containing monomeric units, hydrophobic monomeric units, hydrophilic monomeric units, anionic monomeric units and nonionic monomeric units.

Amine Oxide Monomeric Units

The polymeric suds enhancers of the present invention may comprise an amine oxide monomeric unit having the formula:

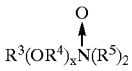

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

A preferred class of amine oxide monomer units suitable for use as a polymeric suds volume and suds duration enhancer has the formula:

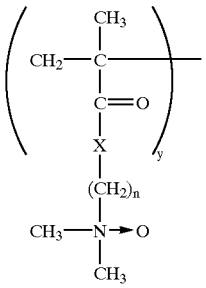

wherein X is either O or N, n is an integer from 1 to 10, preferably from 2 to 6, more preferably 2 to 4.

Cationic Monomeric Units

For the purposes of the present invention the term "cationic monomeric unit" is defined as "a moiety which when incorporated into the structure of the suds enhancers of the present invention, is capable of maintaining a cationic charge within the pH range of from about 4 to about 12. The cationic monomeric unit is not required to be protonated at every pH value within the range of about 4 to about 12." Non-limiting examples of monomeric units which comprise a cationic moiety, other than a quaternary nitrogen-containing moiety, include the cationic monomeric units having the formula:

[I]

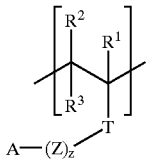

wherein each of $R^1$, $R^2$ and $R^3$ are independently selected from the group consisting of hydrogen, $C_1$ to $C_6$ alkyl, and mixtures thereof, preferably hydrogen, $C_1$ to $C_3$ alkyl, more preferably, hydrogen or methyl. T is selected from the group consisting of substituted or unsubstituted, saturated or unsaturated, linear or branched radicals selected from the group consisting of alkyl, cycloalkyl, aryl, alkaryl, aralkyl, heterocyclic ring, silyl, nitro, halo, cyano, sulfonato, alkoxy, keto, ester, ether, carbonyl, amido, amino, glycidyl, carbanato, carbamate, carboxylic, and carboalkoxy radicals and mixtures thereof. Z is selected from the group consisting of: —($CH_2$)—, ($CH_2$—CH═CH)—, —($CH_2$—CHOH)—, ($CH_2$—$CHNR^4$)—, —($CH_2$—$CHR^5$—O)— and mixtures thereof, preferably —($CH_2$)—. $R^4$ and $R^5$ are selected from the group consisting of hydrogen, $C_1$ to $C_6$ alkyl and mixtures thereof, preferably hydrogen, methyl, ethyl and mixtures thereof; z is an integer selected from about 0 to about 12, preferably about 2 to about 10, more preferably about 2 to about 6. A is $NR^6R^7$ or $NR^6R^7R^8$. Wherein each of $R^6$, $R^7$ and $R^8$, when present, are independently selected from the group consisting of H, $C_1$–$C_8$ linear or branched alkyl, alkyleneoxy having the formula:

$$—(R^9O)_yR^{10}$$

wherein $R^9$ is $C_2$–$C_4$ linear or branched alkylene, and mixtures thereof, $R^{10}$ is hydrogen, $C_1$–$C_4$ alkyl, and mixtures thereof, y is from 1 to about 10. Preferably $R^6$, $R^7$ and $R^8$, when present, are independently, hydrogen, $C_1$ to $C_4$ alkyl. Alternatively, $NR^6R^7$ or $NR^6R^7R^8$ can form a heterocyclic ring containing from 4 to 7 carbon atoms, optionally containing additional hetero atoms, optionally fused to a benzene ring, and optionally substituted by $C_1$ to $C_8$ hydrocarbyl, and/or acetates. Examples of suitable heterocycles, both substituted and unsubstituted, are indolyl, isoindolinyl imidazolyl, imidazolinyl, piperidinyl pyrazolyl, pyrazolinyl, pyridinyl, piperazinyl, pyrrolidinyl, pyrrolidinyl, guanidino, amidino, quinidinyl, thiazolinyl, morpholine and mixtures thereof, with morpholino and piperazinyl being preferred.

Examples of the cationic unit of formula [I] include, but are not limited to, the following structures:

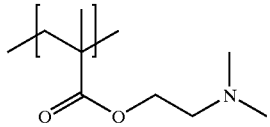

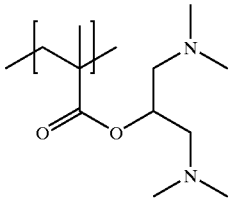

-continued

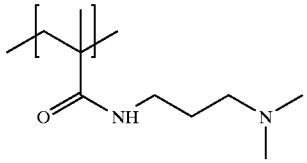

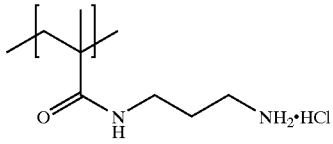

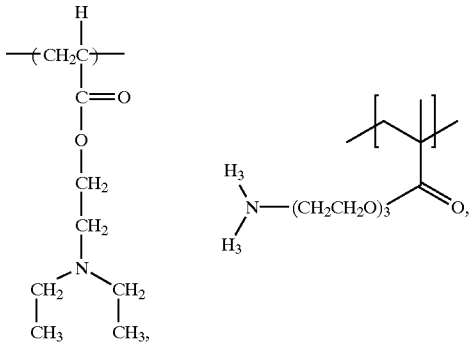

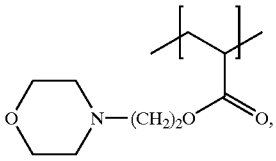

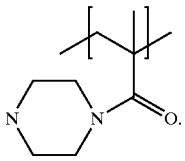

A preferred cationic monomeric unit is 2-dimethylaminoethyl methacrylate (DMAM) having the formula:

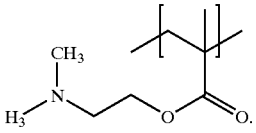

Nonlimiting examples of cationic monomeric units include: methyl chloride quats of dimethylethyl(meth) acrylates, methyl chloride quats of dimethylaminopropyl (meth)acrylamides, dimethyl- and diethylsulfate quats of dimethylaminoethyl(meth)acrylates, dimethyl- and diethylsulfate quats of dimethylaminopropyl(meth)acrylamides, and diallydimethylammonium halides, such as bromide and/or chloride salts.

Hydroxyl-Containing Monomeric Units

The hydroxyl group density of a quaternary nitrogen-containing monomer- and/or zwitterionic monomer-containing polymeric suds enhancer of the present invention is determined by the following calculation.

$$\text{Hydroxyl Group Density} = \frac{[\text{Molecular Weight of Hydroxyl Group}]}{[\text{Total Monomer Molecular Weight}]}$$

For example, the Hydroxyl Group Density of a quaternary nitrogen-containing monomer- and/or zwitterionic monomer-containing polymeric suds enhancer containing 2-dimethylaminoethyl methacrylate having a molecular weight of approximately 157 and hydroxyethylacrylate having a molecular weight of approximately 116 grams/mole, at a 1:3 mole ratio would be calculated as follows:

$$\text{Hydroxyl Group Density} = \frac{[17]}{[3(116) + 157]} = 0.0337$$

Preferably, the quaternary nitrogen-containing or zwitterionic polymeric suds enhancers of the present invention have a Hydroxyl Group Density of about 0.5 or less, preferably from about 0.0001 to about 0.4.

Nonlimiting examples of such hydroxyl group-containing units include, but are not limited to the following:

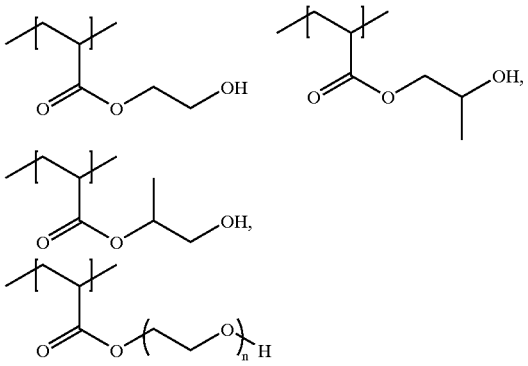

wherein n is an integer from 2 to 100, preferably 2 to 50, more preferably 2 to 30,

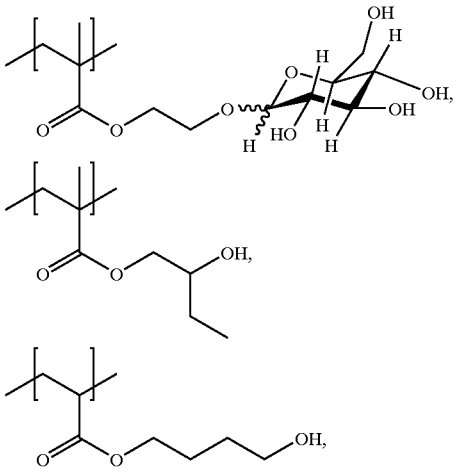

-continued

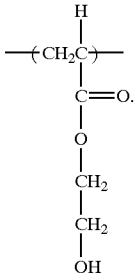

Hydrophobic Group-Containing Monomeric Units

Suitable hydrophobic group-containing monomeric units for use in the present invention include, but are not limited to, hydrophobic groups preferably selected from the group consisting of non-hydroxyl groups, non-cationic groups, non-anionic groups, non-carbonyl groups, and/or non-H-bonding groups, more preferably selected from the group consisting of alkyls, cycloalkyls, aryls, alkaryls, aralkyls and mixtures thereof.

Nonlimiting examples of such hydrophobic group-containing monomeric units include, but are not limited to the following:

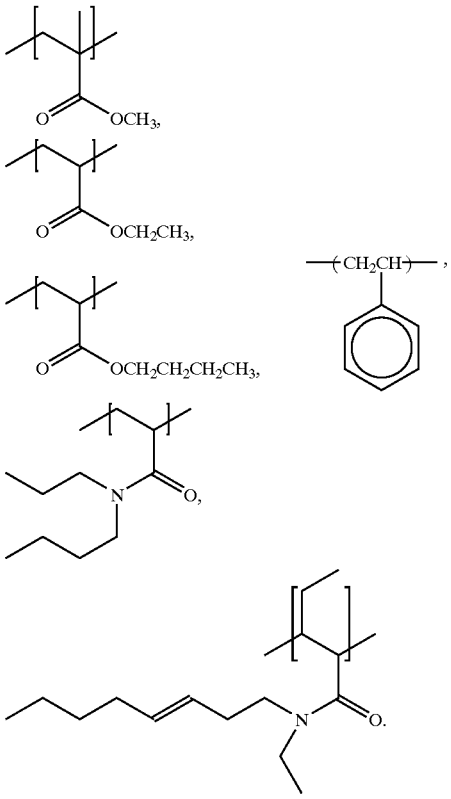

Hydrophilic Group-Containing Monomeric Units

Suitable hydrophilic group-containing monomeric units for use in the present invention include, but are not limited to, hydrophilic groups preferably selected from the group consisting of carboxyl groups, carboxylic acids and their salts, sulfonic acids and their salts, heteroatom-containing moieties present in a ring or linear form and mixtures thereof.

Nonlimiting examples of such hydrophilic group-containing monomeric units include, but are not limited to the following:

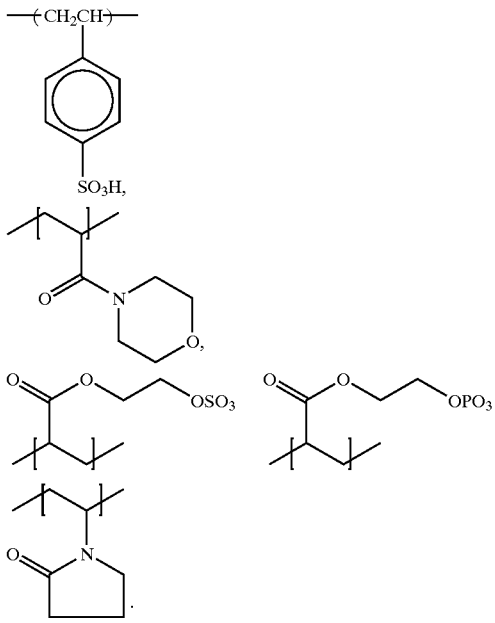

Anionic Monomeric Units

For the purposes of the present invention the term "anionic monomeric unit" is defined as "a moiety which when incorporated into the structure of the suds enhancers of the present invention, is capable of maintaining an anionic charge within the pH range of from about 4 to about 12. The anionic monomeric unit is not required to be de-protonated at every pH value within the range of about 4 to about 12." Nonlimiting examples of anionic monomeric units include: acrylic acid, methacrylic acid, AMPS, vinyl sulfonate, styrene vinyl sulfonate, vinyl phosphonic acid, ethylene glycol methacrylate phosphate, maleic anhydride and acid, fumaric acid, itaconic acid, glutamic acid, aspartic acid, the monomeric unit having the formula:

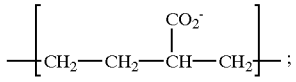

and the monomeric unit having the formula:

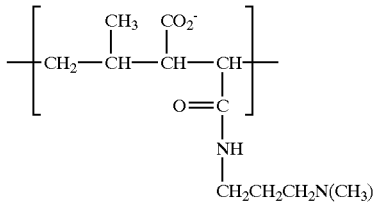

the latter of which also comprises a moiety capable of having a cationic charge at a pH of about 4 to about 12. This latter unit is defined herein as "a unit capable of having an anionic and a cationic charge at a pH of from about 4 to about 12."

Nonionic Monomeric Units

For the purposes of the present invention the term "nonionic monomeric unit" is defined as "a moiety which when incorporated into the structure of the suds enhancers of the present invention, has no charge within the pH range of from about 4 to about 12." Non-limiting examples of units which are "nonionic monomeric units" are styrene, ethylene, propylene, butylene, 1,2-phenylene, esters, amides, ketones, ethers, acrylamide and the N-monosubstituted-(e.g., N-isopropylacrylamide) and N,N-disubstituted (e.g., N,N-dimethylacrylamide) acrylamides, hydroxyethyl(meth) acrylate, hydroxypropyl(meth)acrylate, vinyl pyrrolidone, alkyl substituted alkoxylated(meth)acrylate, dimethylaminoethyl(meth)acrylate, dimethylaminopropyl (meth)acrylamide, vinyl formamide and the like.

The units which comprise the polymers of the present invention may, as single units or monomers, have any $pK_a$ value.

Preferably, the quaternary nitrogen-containing monomer- or zwitterionic monomer-containing polymeric suds enhancers are selected from copolymers, which can optionally be crosslinked, terpolymers and other polymers (or multimers).

Particular Polymers

Preferred polymers of the present invention comprise:

A. at least one monomeric unit selected from the group consisting of:

(i) quaternary nitrogen-containing monomeric units having the formula:

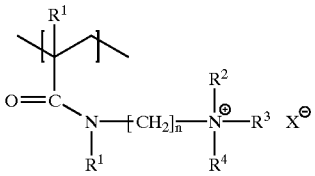

wherein $R^1$ is a hydrogen or a methyl group, preferably a methyl group; $R^2$, $R^3$ and $R^4$ are linear or branched $C_1$–$C_4$ alkyl groups, preferably $C_1$ groups; n represents an integer from 1 to 4, preferably 3; and $X^-$ represents a counterion which is compatible with the water-soluble or water-dispersible nature of the polymer, preferably $Cl^-$; and

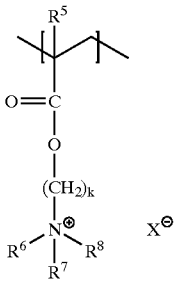

wherein $R^5$, $R^6$, $R^7$ and $R^8$ are independently H, or a $C_1$–$C_4$ alkyl group, preferably a methyl group; k is an integer from 1 to 4, preferably 2; and $X^-$ represents a counterion which is compatible with the water-soluble or water-dispersible nature of the polymer, preferably $Cl^-$;

(ii) zwitterionic monomeric units having the formula:

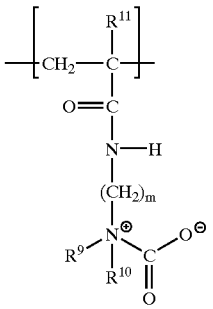

wherein $R^9$, $R^{10}$ and $R^{11}$ are independently H, or a $C_1$–$C_4$ alkyl group, preferably a methyl group; and m is an integer from 1 to 4, preferably 2; and (iii) mixtures thereof.

B. optionally, at least one cationic monomeric unit having a formula:

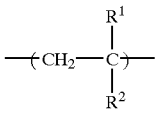

wherein:

$R^1$ is H or an alkyl having 1 to 10 carbon atoms, $R^2$ is a moiety selected from the group consisting of

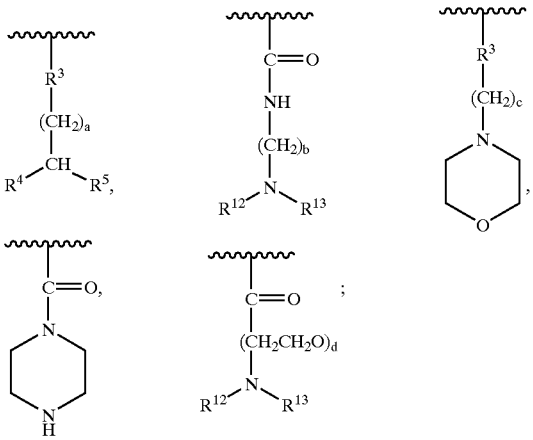

wherein $R^3$ is selected from the group consisting of a is an integer from 0 to 16, preferably 0 to 10;

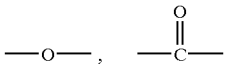

b is an integer from 2 to 10;

c is an integer from 2 to 10;

d is an integer from 1 to 100;

$R^4$ and $R^5$ are independently selected from the group consisting of —H, and

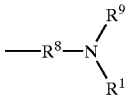

$R^8$ is independently selected from the group consisting of a bond or an alkylene having 1 to 18 carbon atoms;

$R^9$ and $R^{10}$ are independently selected from the group consisting of —H, alkyl having 1 to 8 carbon atoms, and an olefin chain having 2 to 8 carbon atoms;

$R^{12}$ and $R^{13}$ are independently selected from the group consisting of H and alkyl having from 1 to 8 carbon atoms;

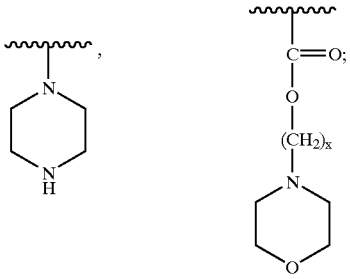

wherein x is an integer from 2 to 10;

C. optionally, at least one monomeric unit selected from the group consisting of:

a monomeric unit of the formula:

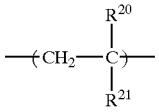

wherein $R^{20}$ is selected from the group consisting of H and $CH_3$;

$R^{21}$ is selected from the group consisting of:

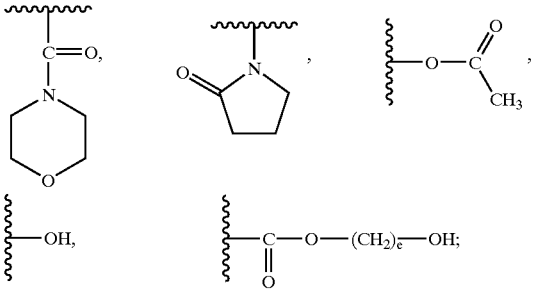

wherein e is an integer from 2 to 25, preferably from 2 to 5;

$$—O—(CH_2)_f—CH_3$$

wherein f is an integer from 0 to 25, preferably from 0 to 12;

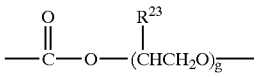

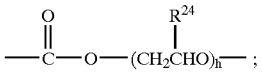

wherein g is an integer from 1 to 100, preferably 1 to 50;

wherein h is an integer from 1 to 100, preferably 1 to 50;

$R^{23}$ is —H, —$CH_3$ or —$C_2H_5$;

$R^{24}$ is —$CH_3$ or —$C_2H_5$;

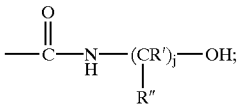

wherein R' and R" are independently H or $CH_3$; and j is an integer from 1 to 25, preferably 2 to 12;

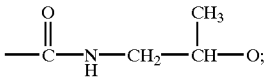

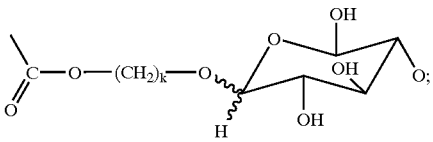

wherein k is an integer from 1 to 25, preferably 1 to 12;

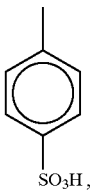

—N—H—$(CH_2)_m$—$NH_2$.HCl, wherein m is an integer from 1 to 25, preferably 2 to 12; and a polyhydroxy monomeric unit of formula:

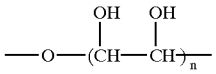

wherein n is an integer from 1 to 50, preferably 1 to 25; and

D. optionally at least one monomeric unit selected from the group consisting of:

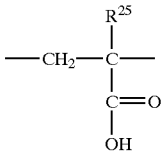

wherein $R^{25}$ is —H or —$CH_3$;

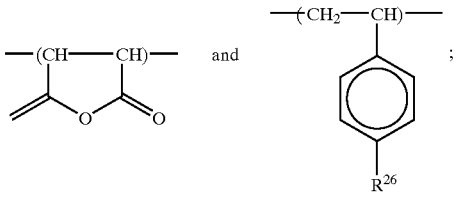

wherein $R^{26}$ is —H.

A preferred terpolymer and/or multimer of the present invention comprises at least one said monomeric unit A, at least one said monomeric unit B and at least one said monomeric unit C.

Preferably, at least one monomeric unit B is selected from the group consisting of:

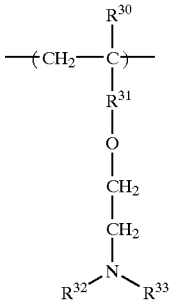

wherein $R^{30}$ is H or —$CH_3$, wherein $R^{31}$ is a bond or

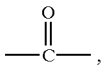

and $R^{32}$ and $R^{33}$ are —$CH_3$ or —$C_2H_5$.

Preferably, the polymer is a terpolymer in which:

said at least one monomeric unit C is selected from the group consisting of:

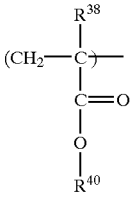

wherein $R^{38}$ is selected from the group consisting of H and $CH_3$ and $R^{40}$ is selected from the group consisting of —$CH_2CH_2$—OH and

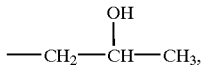

and isomers thereof, and said terpolymer comprising said at least one monomeric unit D.

Preferably, the polymer has at least one monomeric unit C which has the formula:

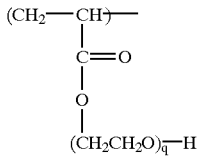

wherein q ranges from 1 to 12, preferably 1 to 10, more preferably 1 to 9.

Preferably, the polymer is a terpolymer, in which at least one monomeric unit B is selected from the group consisting of:

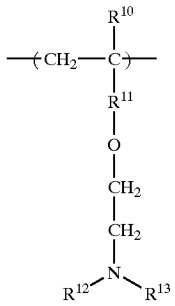

wherein $R^{10}$ is H or $CH_3$;

$R^{11}$ is a bond or

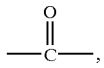

and $R^{12}$ and $R^{13}$ are $—CH_3$ or $—C_2H_5$, and said polymer comprises said at least one monomeric unit D.

Preferably, at least one monomeric unit B has a formula selected from the group consisting of:

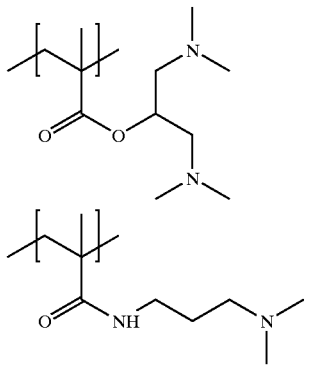

Preferably, at least one monomeric unit B has a formula selected from the group consisting of:

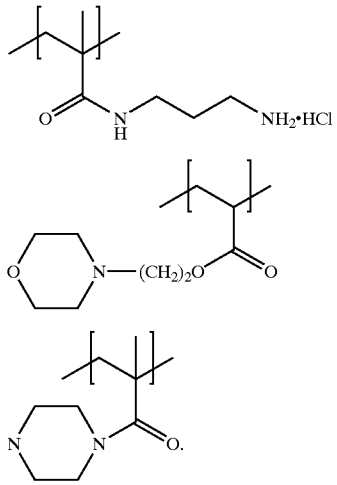

Preferably, at least one one monomeric unit C is selected from the group consisting of:

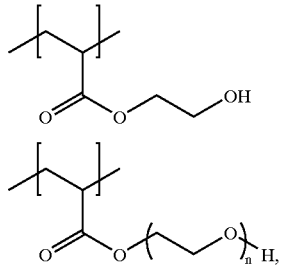

wherein n is an integer from 2 to 50, preferably 2 to 30, more preferably 2 to 27;

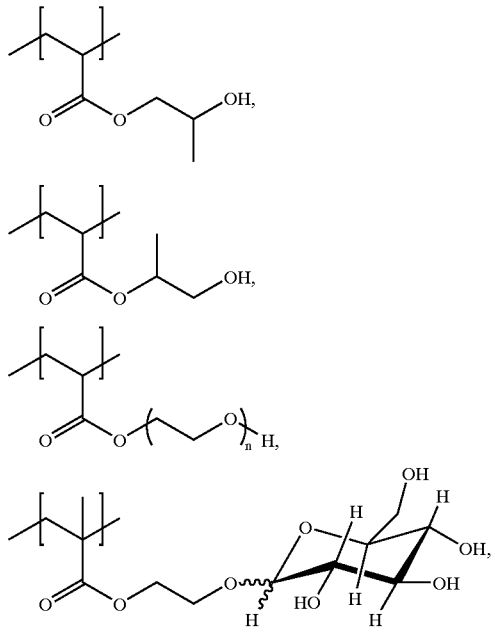

-continued
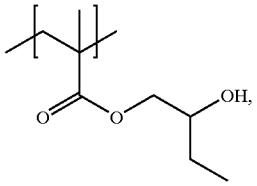
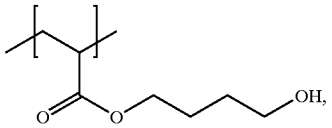
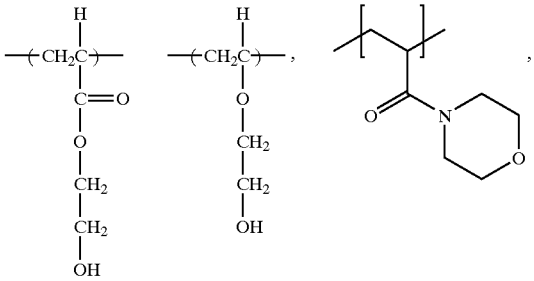
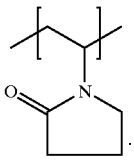
Specific Polymers
Nonlimiting examples of such copolymers, which can optionally be crosslinked, terpolymers and multimers have the following formulas:
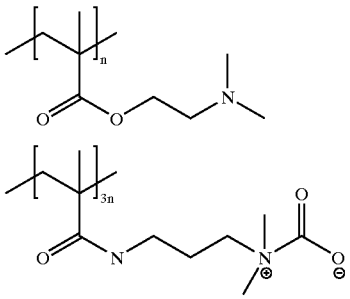
-continued
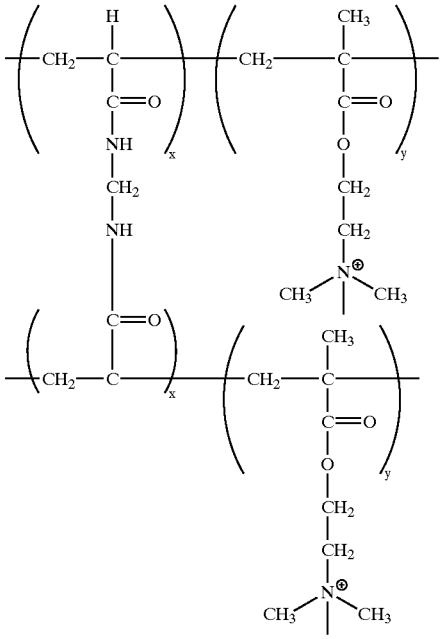
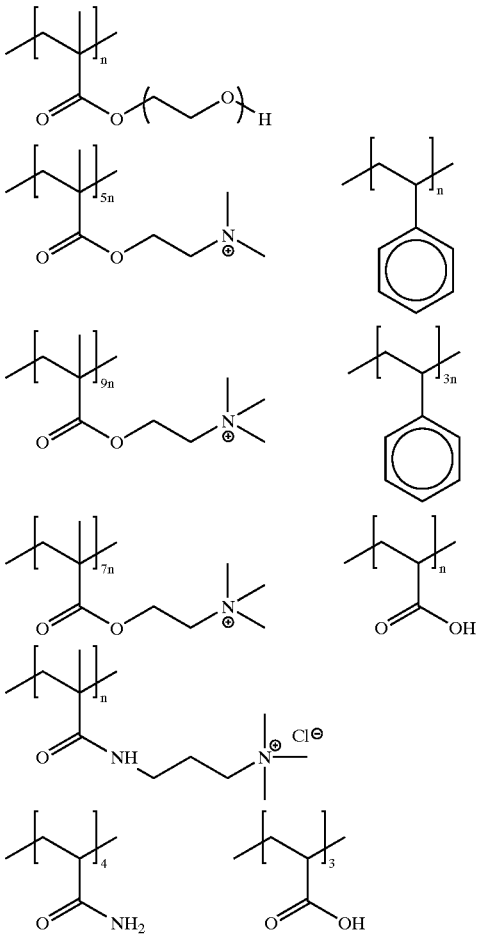

-continued
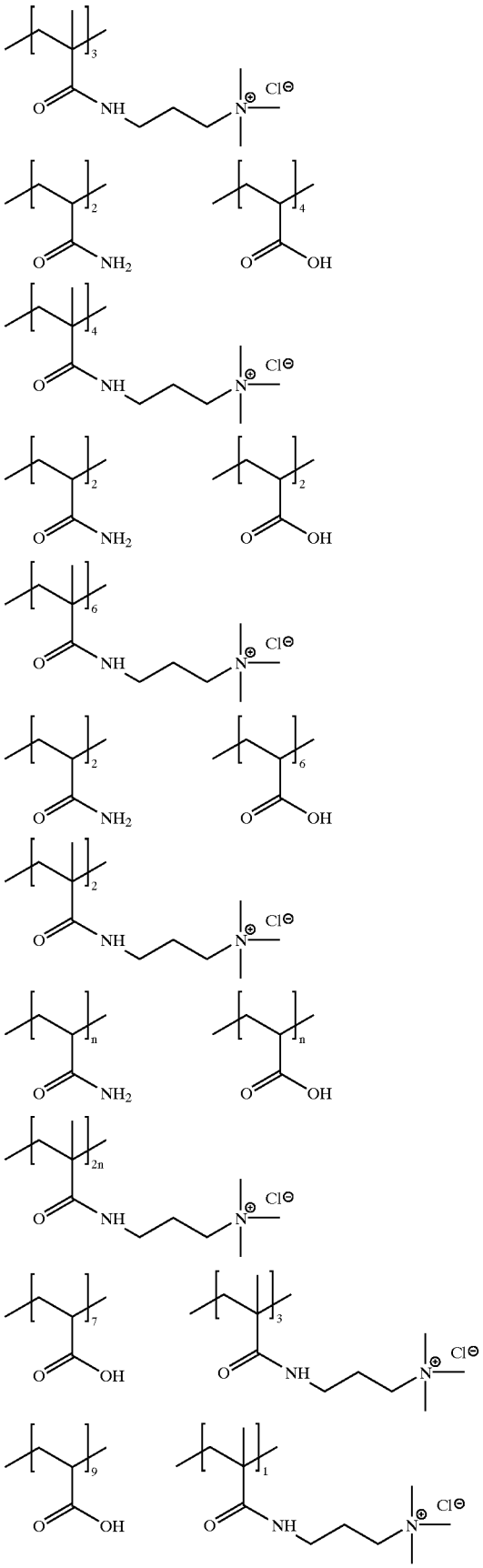
-continued
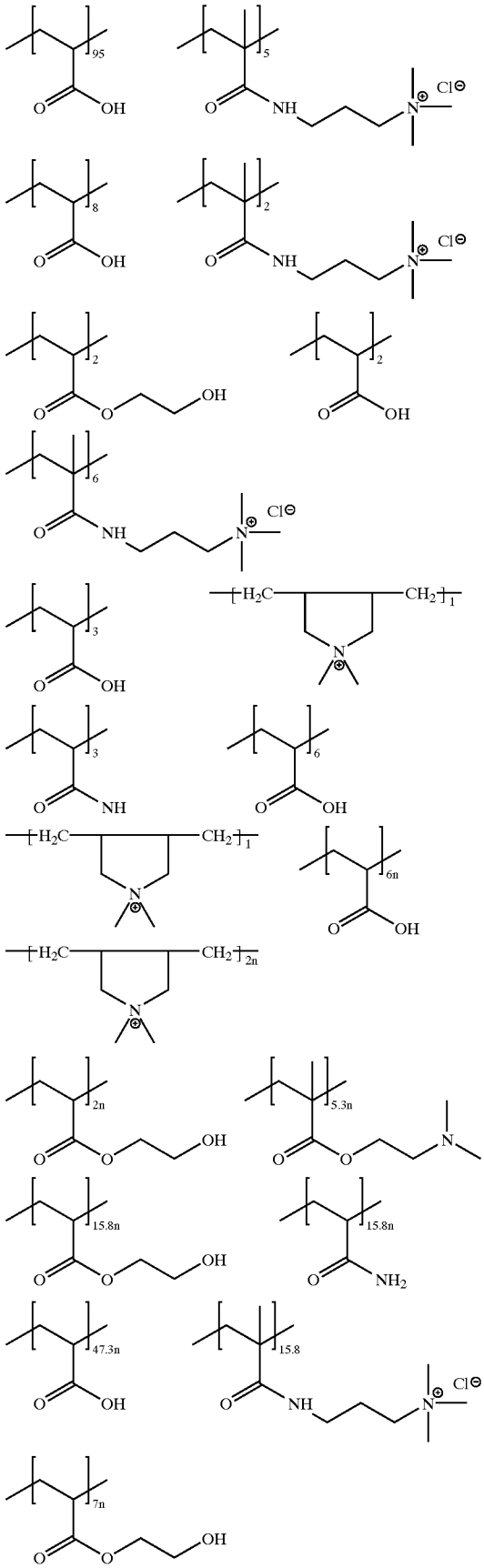

-continued
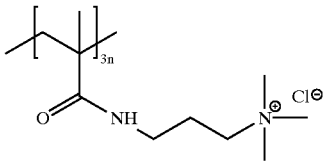
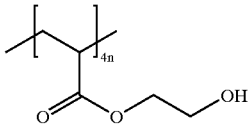
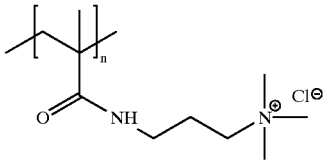
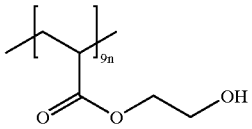
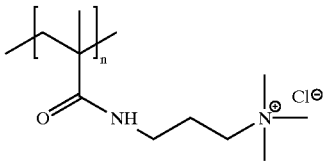
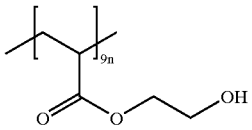
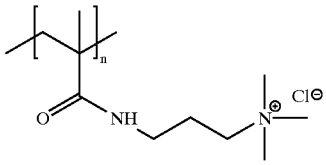
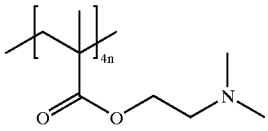
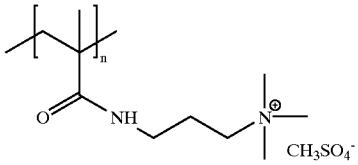
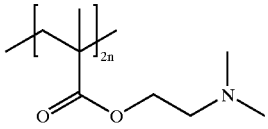
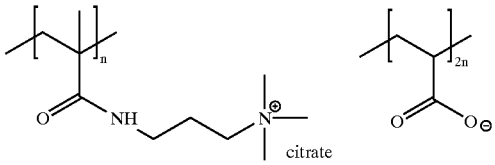
-continued
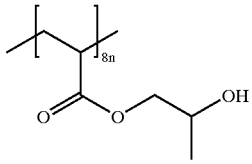
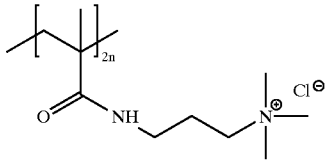
Examples of preferred polymers of the present invention are the following:
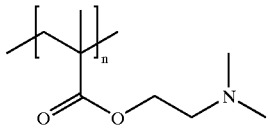
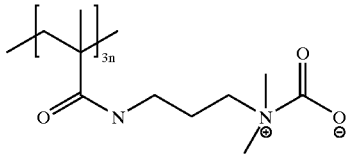
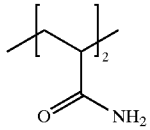
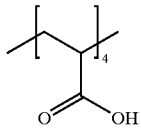
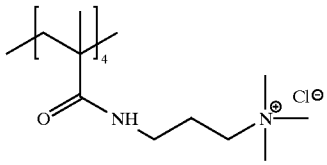
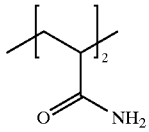
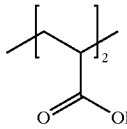
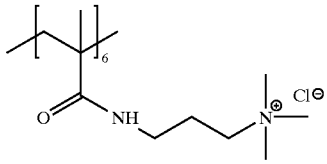
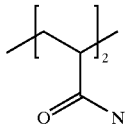
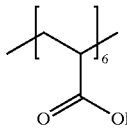
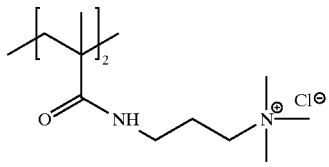
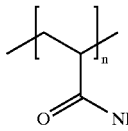
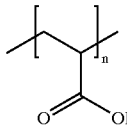
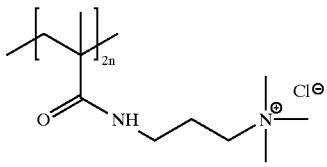

-continued

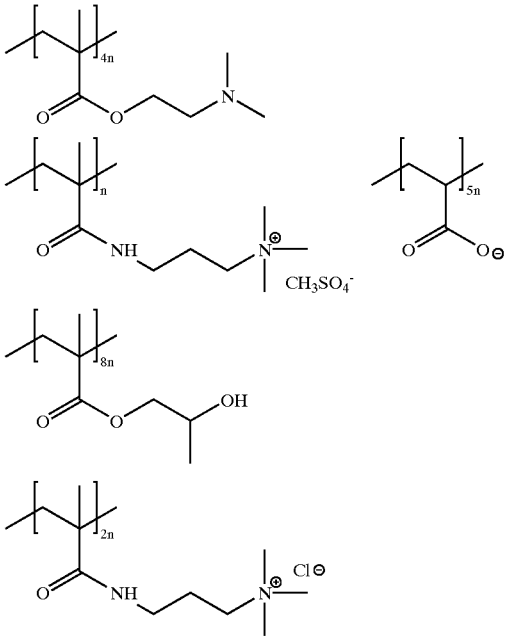

Examples of more preferred polymers of the present invention are the following:

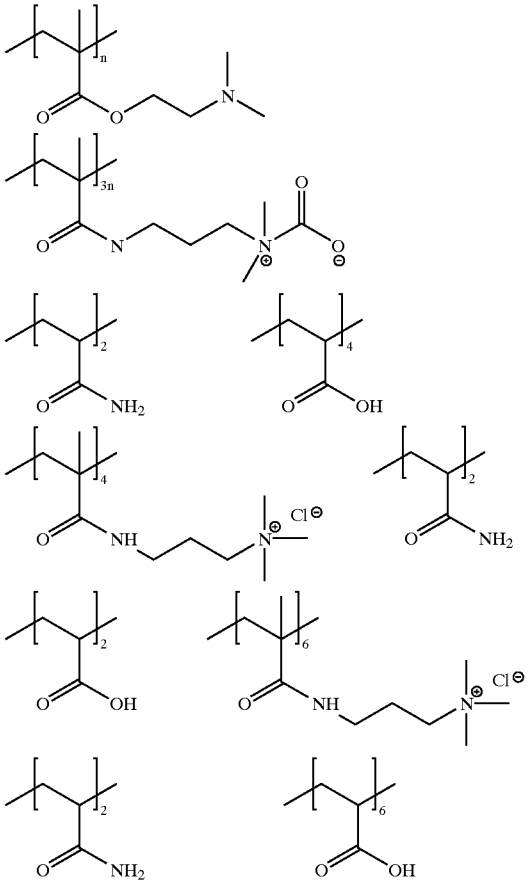

-continued

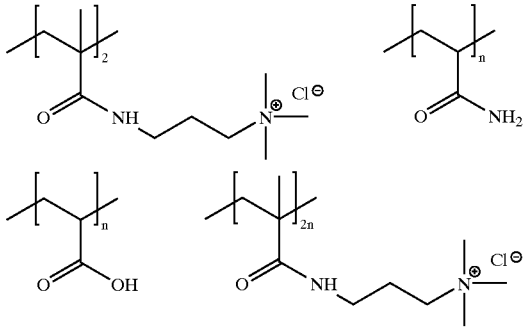

Examples of the most preferred polymers of the present invention include the following:

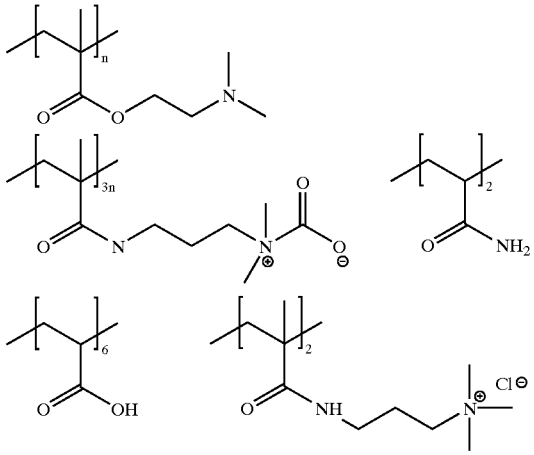

The liquid detergent compositions according to the present invention comprise at least an effective amount of the quaternary nitrogen-containing or zwitterionic polymeric suds enhancers described herein, preferably from about 0.01% to about 10%, more preferably from about 0.001% to about 5%, most preferably from about 0.1% to about 2% by weight, of said composition. What is meant herein by "an effective amount quaternary nitrogen-containing or zwitterionic polymeric suds enhancers" is that the suds volume and suds duration produced by the presently described compositions are sustained for an increased amount of time relative to a composition which does not comprise one or more of the quaternary nitrogen-containing or zwitterionic polymeric suds enhancer described herein. Additionally, the quaternary nitrogen-containing or zwitterionic polymeric suds enhancer can be present as the free base or as a salt. Typical counter ions include, acetate, citrate, maleate, sulfate, chloride, etc.

Proteinaceous Suds Enhancers

The proteinaceous suds enhancers of the present invention can be peptides, polypeptides, amino acid containing copolymers, terpolymers etc., and mixtures thereof. Any suitable amino acid can be used to form the backbone of the peptides, polypeptides, or amino acid, wherein the polymers have an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12.

In general, the amino acids suitable for use in forming the proteinaceous suds enhancers of the present invention have the formula:

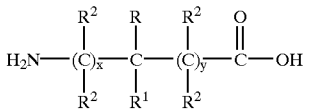

wherein R and $R^1$ are each independently hydrogen, $C_1$–$C_6$ linear or branched alkyl, $C_1$–$C_6$ substituted alkyl, and mixtures thereof. Non-limiting examples of suitable moieties for substitution on the $C_1$–$C_6$ alkyl units include amino, hydroxy, carboxy, amido, thio, thioalkyl, phenyl, substituted phenyl, wherein said phenyl substitution is hydroxy, halogen, amino, carboxy, amido, and mixtures thereof. Further non-limiting examples of suitable moieties for substitution on the R and $R^1$ $C_1$–$C_6$ alkyl units include 3-imidazolyl, 4-imidazolyl, 2-imidazolinyl, 4-imidazolinyl, 2-piperidinyl, 3-piperidinyl, 4-piperidinyl, 1-pyrazolyl, 3-pyrazoyl, 4-pyrazoyl, 5-pyrazoyl, 1-pyrazolinyl, 3-pyrazolinyl, 4-pyrazolinyl, 5-pyrazolinyl, 2-pyridinyl, 3-pyridinyl, 4-pyridinyl, piperazinyl, 2-pyrrolidinyl, 3-pyrrolidinyl, guanidino, amidino, and mixtures thereof. Preferably $R^1$ is hydrogen and at least 10% of R units are moieties which are capable of having a positive or negative charge at a pH of from about 4 to about 12. Each $R^2$ is independently hydrogen, hydroxy, amino, guanidino, $C_1$–$C_4$ alkyl, or comprises a carbon chain which can be taken together with R, $R^1$ any $R^2$ units to form an aromatic or non-aromatic ring having from 5 to 10 carbon atoms wherein said ring may be a single ring or two fused rings, each ring being aromatic, non-aromatic, or mixtures thereof. When the amino acids according to the present invention comprise one or more rings incorporated into the amino acid backbone, then R, $R^1$, and one or more $R^2$ units will provide the necessary carbon-carbon bonds to accommodate the formation of said ring. Preferably when R is hydrogen, $R^1$ is not hydrogen, and vice versa; preferably at least one $R^2$ is hydrogen. The indices x and y are each independently from 0 to 2.

An example of an amino acid according to the present invention which contains a ring as part of the amino acid backbone is 2-aminobenzoic acid (anthranilic acid) having the formula:

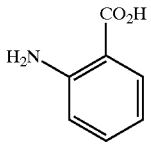

wherein x is equal to 1, y is equal to 0 and R, $R^1$, and 2 $R^2$ units from the same carbon atom are taken together to form a benzene ring.

A further example of an amino acid according to the present invention which contains a ring as part of the amino acid backbone is 3-aminobenzoic acid having the formula:

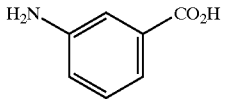

wherein x and y are each equal to 1, R is hydrogen and $R^1$ and four $R^2$ units are taken together to form a benzene ring.

Non-limiting examples of amino acids suitable for use in the proteinaceous suds enhancers of the present invention wherein at least one x or y is not equal to 0 include 2-aminobenzoic acid, 3-aminobenzoic acid, 4-aminobenzoic acid, b-alanine, and b-hydroxyaminobutyric acid.

The preferred amino acids suitable for use in the proteinaceous suds enhancers of the present invention have the formula:

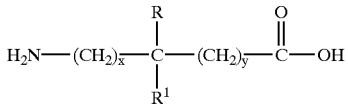

wherein R and $R^1$ are independently hydrogen or a moiety as describe herein above preferably $R^1$ is hydrogen and R comprise a moiety having a positive charge at a pH of from about 4 to about 12 wherein the polymers have an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12.

More preferred amino acids which comprise the proteinaceous suds enhancers of the present invention have the formula:

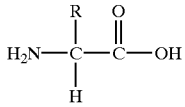

wherein R hydrogen, $C_1$–$C_6$ linear or branched alkyl, $C_1$–$C_6$ substituted alkyl, and mixtures thereof. R is preferably $C_1$–$C_6$ substituted alkyl wherein preferred moieties which are substituted on said $C_1$–$C_6$ alkyl units include amino, hydroxy, carboxy, amido, thio, $C_1$–$C_4$ thioalkyl, 3-imidazolyl, 4-imidazolyl, 2-imidazolinyl, 4-imidazolinyl, 2-piperidinyl, 3-piperidinyl, 4-piperidinyl, 1-pyrazolyl, 3-pyrazoyl, 4-pyrazoyl, 5-pyrazoyl, 1-pyrazolinyl, 3-pyrazolinyl, 4-pyrazolinyl, 5-pyrazolinyl, 2-pyridinyl, 3-pyridinyl, 4-pyridinyl, piperazinyl, 2-pyrrolidinyl, 3-pyrrolidinyl, guanidino, amidino, phenyl, substituted phenyl, wherein said phenyl substitution is hydroxy, halogen, amino, carboxy, and amido.

An example of a more preferred amino acid according to the present invention is the amino acid lysine having the formula:

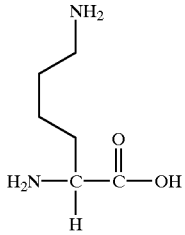

wherein R is a substituted $C_1$ alkyl moiety, said substituent is 4-imidazolyl.

Non-limiting examples of preferred amino acids include alanine, arginine, asparagine, aspartic acid, cysteine, glutamine, glutamic acid, glycine, histidine, isoleucine, leucine, lysine, methionine, phenylalanine, proline, serine, threonine, tryptophan, tyrosine, valine, and mixtures thereof.

The aforementioned amino acids are typically referred to as the "primary a-amino acids", however, the proteinaceous suds enhancers of the present invention may comprise any amino acid having an R unit which together with the aforementioned amino acids serves to adjust the cationic charge density of the proteinaceous suds enhancers to a range of 2.8 or less, preferably from about 0.01 to about 2.8, more preferably from about 0.1 to about 2.75, most preferably from about 0.75 to about 2.25 units per 100 daltons molecular weight at a pH of from about 4 to about 12. For example, further non-limiting examples of amino acids include homoserine, hydroxyproline, norleucine, norvaline, ornithine, penicillamine, and phenylglycine, preferably ornithine. R units preferably comprise moieties which are capable of a cationic or anionic charges within the range of pH from about 4 to about 12. Non-limiting examples of preferred amino acids having anionic R units include glutamic acid, aspartic acid, and g-carboxyglutamic acid.

For the purposes of the present invention, both optical isomers of any amino acid having a chiral center serve equally well for inclusion into the backbone of the peptide, polypeptide, or amino acid copolymers. Racemic mixtures of one amino acid may be suitably combined with a single optical isomer of one or more other amino acids depending upon the desired properties of the final proteinaceous suds enhancer. The same applies to amino acids capable of forming diasteriomeric pairs, for example, threonine.

Nonlimiting examples of suitable proteinaceous suds enhancers are described in PCT application Ser. No. PCT/US98/24707.

Polyamino Acid Proteinaceous Suds enhancer—One type of suitable proteinaceous suds enhancer according to the present invention is comprised entirely of the amino acids described herein above. Said polyamino acid compounds may be naturally occurring peptides, polypeptides, enzymes, and the like, provided that the polymers have an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12. An example of a polyamino acid which is suitable as a proteinaceous suds enhancer according to the present invention is the enzyme lysozyme.

An exception may, from time to time, occur in the case where naturally occurring enzymes, proteins, and peptides are chosen as proteinaceous suds enhancers provided that the polymers have an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12.

Another class of suitable polyamino acid compound is the synthetic peptide having a molecular weight of at least about 1500 daltons. In addition, the polymers have an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12. An example of a polyamino acid synthetic peptide suitable for use as a proteinaceous suds enhancer according to the present invention is the copolymer of the amino acids lysine, alanine, glutamic acid, and tyrosine having an average molecular weight of 52,000 daltons and a ratio of lys:ala:glu:tyr of approximately 5:6:2:1.

Without wishing to be limited by theory, the presence of one or more cationic amino acids, for example, histidine, ornithine, lysine and the like, is required to insure increased suds stabilization and suds volume. However, the relative amount of cationic amino acid present, as well as the average cationic charge density of the polyamino acid, are key to the effectiveness of the resulting material. For example, poly L-lysine having a molecular weight of approximately 18,000 daltons comprises 100% amino acids which have the capacity to possess a positive charge in the pH range of from about 4 to about 12, with the result that this material is ineffective as a suds extender and as a greasy soil removing agent.

Peptide Copolymers—Another class of materials suitable for use as proteinaceous suds enhancers according to the present invention are peptide copolymers. For the purposes of the present invention "peptide copolymers" are defined as "polymeric materials with a molecular weight greater than or equal to about 1500 daltons wherein at least about 10% by weight of said polymeric material comprises one or more amino acids".

Peptide copolymers suitable for use as proteinaceous suds enhancers may include segments of polyethylene oxide which are linked to segments of peptide or polypeptide to form a material which has increased suds retention as well as formulatability.

Nonlimiting examples of amino acid copolymer classes include the following.

Polyalkyleneimine copolymers comprise random segments of polyalkyleneimine, preferably polyethyleneimine, together with segments of amino acid residues. For example, tetraethylenepentamine is reacted together with polyglutamic acid and polyalanine to form a copolymer having the formula:

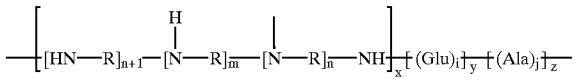

wherein m is equal to 3, n is equal to 0, i is equal to 3, j is equal to 5, x is equal to 3, y is equal to 4, and z is equal to 7.

However, the formulator may substitute other polyamines for polyalkyleneimines, for example, polyvinyl amines, or other suitable polyamine which provides for a source of cationic charge at a pH of from 4 to abut 12 and which results in a copolymer having an average cationic charge density of 2.8 or less, preferably from about 0.01 to about 2.8, more preferably from about 0.1 to about 2.75, most preferably from about 0.75 to about 2.25 units per 100 daltons molecular weight at a pH of from about 4 to about 12.

The formulator may combine non-amine polymers with protonatable as well as non-protonatable amino acids. For example, a carboxylate-containing homo-polymer may be reacted with one or more amino acids, for example, histidine and glycine, to form an amino acid containing amido copolymer having the formula:

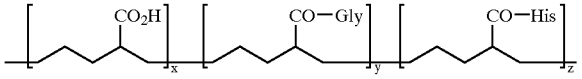

wherein said copolymer has a molecular weight of at least 1500 daltons and a ratio of x:y:z of approximately 2:3:6.

Zwitterionic Polymers

The quaternary nitrogen-containing or zwitterionic polymeric suds enhancers of the present invention are homopolymers or copolymers wherein the monomers which comprise said homopolymers or copolymers contain a moiety capable of being protonated at a pH of from about 4 to about 12, or a moiety capable of being de-protonated at a pH of from about 4 to about 12, of a mixture of both types of moieties.

A preferred class of zwitterionic polymers suitable for use as a suds volume and suds duration enhancer has the formula:

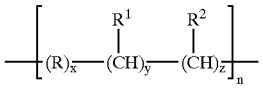

wherein R is $C_1$–$C_{12}$ linear alkylene, $C_1$–$C_{12}$ branched alkylene, and mixtures thereof; preferably $C_1$–$C_4$ linear alkylene, $C_3$–$C_4$ branched alkylene; more preferably methylene and 1,2-propylene. The index x is from 0 to 6; y is 0 or 1; z is 0 or 1.

The index n has the value such that the zwitterionic polymers of the present invention have an average molecular weight of from about 1,000 to about 2,000,000 preferably from about 5,000 to about 1,000,000, more preferably from about 10,000 to about 750,000, more preferably from about 20,000 to about 500,000, even more preferably from about 35,000 to about 300,000 daltons. The molecular weight of the quaternary nitrogen-containing or zwitterionic polymeric suds boosters, can be determined via conventional gel permeation chromatography.

Nonlimiting examples of suitable zwitterionic polymers are described in PCT application Ser. No. PCT/US98/24699

Cationic Charge Density

For the purposes of the present invention the term "cationic charge density" is defined as "the total number of units that are protonated at a specific pH per 100 daltons mass of polymer, or otherwise stated, the total number of charges divided by the dalton molecular weight of the monomer unit or polymer."

For illustrative purposes only, a polypeptide comprising 10 units of the amino acid lysine has a molecular weight of approximately 1028 daltons, wherein there are 11 —$NH_2$ units. If at a specific pH within the range of from about 4 to about 12, 2 of the —$NH_2$ units are protonated in the form of —$NH_3^+$, then the cationic charge density is 2 cationic charge units÷by 1028 daltons molecular weight=approximately 0.2 units of cationic charge per 100 daltons molecular weight. This would, therefore, have sufficient cationic charge to suffice the cationic charge density of the present invention, but insufficient molecular weight to be a suitable suds enhancer.

Polymers have been shown to be effective for delivering sudsing benefits in a hand dishwashing context, provided the polymer contains a cationic moiety, either permanent via a quaternary nitrogen or temporary via protonation. Without being limited by theory, it is believed that the cationic charge must be sufficient to attract the polymer to negatively charged soils but not so large as to cause negative interactions with available anionic surfactants.

The cationic charge density may be determined as follows, where the cationic charge density is defined as the amount of cationic charge on a given polymer, either by permanent cationic groups or via protonated groups, as a weight percent of the total polymer at the desired wash pH. For example, with the terpolymer, DMAM/hydroxyethylacrylate (HEA)/acrylic acid (AA) where the ratio of monomers is 1 mole of DMAM for 3 moles of HEA for 0.33 moles of AA, we have experimentally determined the pKa, see hereinafter as to how pKa is measured, of this polymer to be 8.2. Thus, if the wash pH is 8.2, then half of the available nitrogens will be protonated (and count as cationic) and the other half will not be protonated (and not be counted in the "cationic charge density"). Thus, since the Nitrogen has a molecular weight of approximately 14 grams/mole, the DMAM monomer has a molecular weight of approximately 157 grams/mole, the HEA monomer has a molecular weight of approximately 116 grams/mole, and the AA monomer has a molecular weight of approximately 72 grams/mole, the cationic charge density can be calculated as follows:

Cationic Charge Density=(14/157+116+116+116+72)*50%=0.0132 or 1.32%.

Thus, 1.32% of the polymer contains cationic charges. Otherwise stated, the cationic charge density is 1.32 per 100 daltons molecular weight.

As another example, one could make a copolymer of DMAM with hydroxyethylacrylate (HEA), where the ratio of monomers is 1 mole of DMAM for 3 moles of HEA. The DMAM monomer has a molecular weight of approximately 157 and the HEA monomer has a molecular weight of 116 grams/mole. In this case the pKa has been measured to be 7.6. Thus, if the wash pH is 5.0, all of the available nitrogens will be protonated. The cationic charge density is then calculated:

Cationic Charge Density=14/(157+116+116+116)*100%=0.0277, or 2.77%.

Thus, the cationic charge density is 2.77 per 100 daltons molecular weight. Notice that in this example, the minimum repeating unit is considered 1 DMAM monomer plus 3 HEA monomers.

Alternatively, the cationic charge density can be determined as follows: where the cationic charge density is defined as the total number of charges divided by the dalton molecular weight of the polymer at the desired wash pH. It can be calculated from the following equation $$\text{Cationic Charge Density} = \frac{\sum_i n_i f_i C_i}{\sum_j m_j}$$

where $n_i$ is the number of charged unit. $f_i$ is the fraction of unit being charged. In the case of protonated species ($AH^+$), $f_i$ can be calculated from the measured pH and pKa.

$$f_{(AH+)} = \frac{10^{pKa-pH}}{1+10^{pKa-pH}}$$

In the case of deprotonated anionic species ($A^-$)

$$f_{(A-)} = \frac{10^{pH-pKa}}{1+10^{pH-pKa}}$$

$C_i$ is the charge of the unit, my is the dalton molecular weight of the individual monomer units.

For example, with polyDMAM, we have experimentally determined the pKa, see hereinafter as to how pKa is measured, of this polymer to be 7.7. Thus, if the wash pH is 7.7, then half of the available nitrogens will be protonated (and count as cationic) $f_{(AH+)}$=0.5 and the other half will not be protonated (and not be counted in the "cationic charge density"). Thus, since the DMAM monomer has a molecular weight of approximately 157 grams/mole, the cationic charge density can be calculated:

Cationic Charge Density=(1*0.5/157)=0.00318 or 0.318%.

Thus, at the wash pH of 7.7, polyDMAM has a cationic charge density of 0.318 charge per 100 dalton molecular weight. As another example, one could make a copolymer of DMAM with DMA, where the ratio of monomers is 1 mole of DMAM for 3 moles of DMA. The DMA monomer has a molecular weight of 99 grams/mole. In this case the pKa has been measured to be 7.6. Thus, if the wash pH is 5.0, all of the available nitrogens will be protonated. The cationic charge density is then calculated:

Cationic Charge Density=1/(157+99+99+99)=0.0022, or 0.22%.

At the wash pH of 5.0, a copolymer of DMAM with DMA has a charge density of 0.22 charge per 100 dalton molecular weight. Notice that in this example, the minimum repeating unit is considered 1 DMAM monomer plus 3 DMA monomers.

A key aspect of this calculation is the pKa measurement for any protonatable species which will result in a cationic charge on the heteroatom. Since the pKa is dependent on the polymer structure and various monomers present, this must be measure to determine the percentage of protonatable sites to count as a function of the desired wash pH. This is an easy exercise for one skilled in the art. Based on this calculation, the percent of cationic charge is independent of polymer molecular weight.

The pKa of a polymeric suds booster is determined in the following manner. Make at least 50 mls of a 5% polymer solution, such as a polymer prepared according to any of Examples 1 to 5 as described hereinafter, in ultra pure water(i.e. no added salt). At 25° C., take initial pH of the 5% polymer solution with a pH meter and record when a steady reading is achieved. Maintain temperature throughout the test at 25° C. with a water bath and stir continuously. Raise pH of 50 mls of the aqueous polymer solution to 12 using NaOH (1N, 12.5M). Titrate 5 mls of 0.1N HCl into the polymer solution. Record pH when steady reading is achieved. Repeat steps 4 and 5 until pH is below 3. The pKa was determined from a plot of pH vs. volume of titrant using the standard procedure as disclosed in Quantitative Chemical Analysis, Daniel C. Harris, W. H. Freeman & Chapman, San Francisco, USA 1982.

It has been surprisingly found that when a polymeric suds booster of the present invention is at its optimum charge density, then reducing the molecular weight of the polymeric suds booster increases sudsing performance even in the presence of composite and/or greasy soils. Accordingly, then the polymeric suds booster is at its optimum charge density, the molecular weight of the polymeric suds booster, as determined in the manner described hereinbefore, is preferably in the range of from about 1,000 to about 2,000,000, more preferably from about 5,000 to about 500,000, even more preferably from about 10,000 to about 100,000, most preferably from about 20,000 to about 50,000 daltons.

METHODS OF USE

The present invention relates to a method for providing increased suds volume and increased suds retention in suds-forming and/or foam-forming compositions, such as liquid dishwashing compositions, personal care compositions (i.e., shampoos, hand washing compositions, body washing composition, hair removal compositions, etc.), laundry detergent compositions, especially laundry bars and/or high suds phosphate laundry compositions, hard surface cleaning compositions, agrochemical foaming compositions, oil-field foaming compositions and/or fire-firefighting foaming compositions.

LIQUID DISHWASHING COMPOSITIONS

The liquid detergent compositions according to the present invention comprise at least an effective amount of one or more quaternary nitrogen-containing or zwitterionic polymeric suds enhancers described herein, preferably from about 0.01% to about 10%, more preferably from about 0.001% to about 5%, most preferably from about 0.1% to about 2% by weight, of said composition and optionally, but typically, the balance comprising one or more cleaning adjuncts. Nonlimiting examples of suitable cleaning adjuncts include surfactants including diamines, amine oxides, betaines and/or sultaines, enzymes, builders, solvents such as water and/or other carriers, hydrotropes, calcium and/or magnesium ion-containing materials, pH agents, perfumes, chelants, soil release polymers, polymeric dispersants, polysaccharides, abrasives, bactericides, tarnish inhibitors, opacifiers, dyes, buffers, antifungal or mildew control agents, thickeners, processing aids, suds boosters, brighteners, anti-corrosive aids, stabilizers, antioxidants and other suitable adjuncts known by those of ordinary skill in the art.

The compositions of this invention can be used to form aqueous washing solutions for use in hand dishwashing. Generally, an effective amount of such compositions is added to water to form such aqueous cleaning or soaking solutions. The aqueous solution so formed is then contacted with the dishware, tableware, and cooking utensils.

An effective amount of the detergent compositions herein added to water to form aqueous cleaning solutions can comprise amounts sufficient to form from about 500 to 20,000 ppm of composition in aqueous solution. More preferably, from about 800 to 5,000 ppm of the detergent compositions herein will be provided in aqueous cleaning liquor.

The liquid dishwashing compositions of the present invention also provide a means for preventing the redeposition of grease, oils, and dirt, especially grease, from the hand washing solution onto dishware. This method comprises contacting an aqueous solution of the compositions of the present invention with soiled dishware and washing said dishware with said aqueous solution.

An effective amount of the detergent compositions herein added to water to form aqueous cleaning solutions according to the method of the present invention comprises amounts sufficient to form from about 500 to 20,000 ppm of composition in aqueous solution. More preferably, from about 800 to 2,500 ppm of the detergent compositions herein will be provided in aqueous cleaning liquor.

The liquid detergent compositions of the present invention are effective for preventing the redeposition of grease from the wash solution back onto the dishware during washing. One measure of effectiveness of the compositions of the present invention involves redeposition tests. The following test and others of similar nature are used to evaluate the suitability of the formulas described herein.

A polyethylene 2 L graduated cylinder is filled to the 1 L graduation mark with an aqueous (water=7 grain) solution comprising from about 500 to about 20,000 ppm of a liquid detergent composition according to the present invention. A synthetic greasy soil composition is then added to the cylinder and the solution is agitated. After a period of time the solution is decanted from the graduated cylinder and the interior walls of the graduated cylinder are rinsed with a suitable solvent or combination of solvents to recover any re-deposited greasy soil. The solvent is removed and the weight of greasy soil which remains in solution is determined by subtracting the amount of soil recovered from the amount initially added to the aqueous solution.

Other re-deposition test include immersion of tableware, flatware, and the like and recovering any re-deposited soil.

The above test can be further modified to determine the increased amount of suds volume and suds duration. The solution is first agitated then subsequently challenged with portions of greasy soil with agitation between each subsequent soil addition. The suds volume can be easily determined by using the vacant volume of the 2 L cylinder as a guide.

The present invention is further illustrated by the following examples of quaternary nitrogen-containing monomer and/or zwitterionic monomer-containing polymeric suds enhancers (enhancing agents), provided that no observations or other statements made therein should be construed to limit the invention, unless otherwise expressly indicated in the claims appended hereto. All amounts, parts, percentages, and ratios expressed in this specification, including the claims are by weight unless otherwise apparent in context.

SYNTHESIS EXAMPLES

Example 1

Preparation of Poly(AM-co-AA-co-MAPTAC) (2:6:2) Terpolymer

To a one-liter reaction flask, add sequentially demineralized water, 687.1 g, acrylamide (52%), 53.8 g, acrylic acid, 85.1 g, diethylaminopropylmethacrylamde methylchloride quaternium salt, MAPTAC (50%), 173.8 g, and EDTA (40%), 0.2 g, then the resulting mixture is heated to 80° C. under gentle nitrogen purging. The pH of the monomers solution is about 2.4. When the temperature reaches 80° C., sodium persulfate solution (1 g in 1 g demineralized water) is added all at once. Polymerization starts within five minutes, and cooling is needed to control the exotherm at the desired temperature. Maintain the temperature at 80° C. for two hours and during this time the batch is getting viscous. Add a second portion of sodium persulfate solution (0.1 g in 1 g demineralized water) at the end of the one-hour hold, the batch is then heated up to 90° C. and maintained at 90° C. for two hours. Cool the batch to room temperature following the two hours at 90° C. The conversion is higher than 99.9% and the viscosity at 25° C. is about 42,500 cps at 20.5% solids, and the pH of the solution is about 2.5.

The above example is the synthesis of a terpolymer of acrylamide:acrylic acid:MAPTAC of a molar ratio of 2:6:2.

Many other polymers of various compositions can be synthesized according to the above typical procedure or with few modifications such as reaction temperature (60°–90° C.), amount of initiator, pH, and the ways of introducing the monomers to the reactor.

Examples of the neutral monomers include acrylamide and the N-monosubstituted- (e.g N-isopropylacrylamide) and N,N-disubstituted (N,N-dimethylacrylamide) acrylamides, hydroxyethyl(meth)acrylate, hydroxypropyl (meth)acrylate, vinyl pyrrolidone, alkyl substitutred alkoxylated (meth)acrylate, dimethylaminoethyl(meth)acrylate, dimethylaminopropyl(meth)acrylamide, and vinyl formamide.

Examples of anionic monomers are acrylic acid, methacrylic acid, AMPS, vinyl sulfonate, styrene vinyl sulfonate, vinyl phosphonic acid, ethylene glycol methacrylate phosphate, maleic anhydride and acid, furmaic acid, and itaconic acid.

Cationic monomers are methyl chloride quats of dimethylethyl(meth)acrylates, methyl chloride quats of dimethylaminopropyl(meth)acrylamides, dimethyl-and diethylsulfate quats of dimethylaminoethyl(meth)acrylates, dimethyl-and diethylsulfate quats of dimethyaminopropyl (meth)acrylamides, and diallydimethylammonium halides (such as bromide and chloride salts).

FORMULATION EXAMPLES

In the following examples, the suds boosting polymer can be any of the suds boosting polymers described herein, preferably one of the suds boosting polymers according to Synthesis Examples 1–2 above.

Example 1

A liquid dishwasing composition according to the present invention is formulated as follows:

| INGREDIENTS (weight %) | # 1 | # 2 | # 3 |
|---|---|---|---|
| Surfactant | | | |
| Alkyl ethoxy sulfate | 27.0 | 27.0 | 27.0 |
| Amine oxide | 6.5 | 6.5 | 6.5 |
| Alcohol ethoxylate | 3.0 | 3.0 | 3.0 |
| Diamine Technology | | | |
| Diamine | 0.50 | 0.50 | 0.50 |
| Suds Boosting Polymer Technology | | | |
| Suds Boosting Compound | 0.5 | 1.0 | 2.0 |
| Buffers/Alkalinity | | | |
| NaOH | to pH | to pH | to pH |
| Solvent/Hydrotropes/Salts | | | |
| Ethanol | 6.5 | 5.0 | 8.0 |
| Propylene Glycol | 1.5 | 2.5 | 0.5 |
| NaCl | 0.8 | 0 | 0.1 |
| Sodium Cumene Sulfonate | 3.0 | 4.5 | 1.5 |
| Poly Propylene Glycol (Mw 2000 or 2600) | 0 | 3.0 | 2.0 |
| Perfume | | | |
| Perfume | 0.36 | 0.36 | 0.36 |
| pH (10% pc) | 8.9 | 8.7 | 8.5 |

Example 2

A liquid dishwasing composition according to the present invention is formulated as follows:

| | | |
|---|---|---|
| Surfactant | | |
| NaAE0.6S | 27.0 | 27.0 |
| C12/14 dimethyl amine oxide | 6.5 | 6.5 |
| C11E9 | 3.0 | 3.0 |
| Total Surfactant | 36.5 | 36.5 |
| Diamine Technology | | |
| 1,3 BAC diamine | 0.50 | 0.50 |
| New Suds Boosting Polymer Technology | | |
| 2:6:2 Acryl Amide:Acrylic Acid: Methacrylamide Amido Propyl Trimethyl Ammonimum Chloride Mw 700K | 1.5 | 1.0 |
| 3:1 Hydroxy Propyl Acrylate:DMAM - Mw 265K | — | 0.5 |
| Buffers/Alkalinity | | |
| NaOH | adjusted | adjusted |
| Solvent/Hydrotropes/Salts | | |
| Ethanol | 6.5 (5.0–8.0) | 6.5 (5.0–8.0) |
| Propylene Glycol | 0.5 (0.5–2.5) | 0.5 (0.5–2.5) |
| NaCl | 0.9 (0–1.0) | 0.9 (0–1.0) |
| Sodium Cumene Sulfonate | 2.5 (1.5–4.5) | 2.5 (1.5–4.5) |
| Poly Propylene Glycol (Mw 2000 or 2600) | 2.0 (0–3.0) | 2.0 (0–3.0) |
| Perfume | 0.36 | 0.36 |
| Viscosity (cps) | 330 | 330 |
| pH (10% pc) | 8.5 | 8.5 |

While particular embodiments of the subject invention have been described, it will be obvious to those skilled in the art that various changes and modifications of the subject invention can be made without departing from the spirit and scope of the invention. It is intended to cover, in the appended claims, all such modifications that are within the scope of the invention.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

In addition to the above examples, the cleaning compositions of the present invention can be formulated into any suitable laundry detergent composition, non-limiting examples of which are described in U.S. Pat. No. 5,679,630 Baeck et al., issued Oct. 21, 1997; U.S. Pat. No. 5,565,145 Watson et al., issued Oct. 15, 1996; U.S. Pat. No. 5,478,489 Fredj et al., issued Dec. 26, 1995; U.S. Pat. No. 5,470,507 Fredj et al., issued Nov. 28, 1995; U.S. Pat. No. 5,466,802 Panandiker et al., issued Nov. 14, 1995; U.S. Pat. No. 5,460,752 Fredj et al., issued Oct. 24, 1995; U.S. Pat. No. 5,458,810 Fredj et al., issued Oct. 17, 1995; U.S. Pat. No. 5,458,809 Fredj et al., issued Oct. 17, 1995; U.S. Pat. No. 5,288,431 Huber et al., issued Feb. 22, 1994 all of which are incorporated herein by reference.

Having described the invention in detail with reference to preferred embodiments and the examples, it will be clear to those skilled in the art that various changes and modifications may be made without departing from the scope of the invention and the invention is not to be considered limited to what is described in the specification.

What is claimed is:

1. A liquid detergent composition having increased suds volume and suds retention suitable for use in hand dishwashing, said compositions comprising:

a) an effective amount of a quaternary nitrogen-containing monomeric unit or zwitterionic monomeric unit-containing polymeric suds enhancer, said enhancer comprising:

i) units selected from the group consisting of units having the formula:

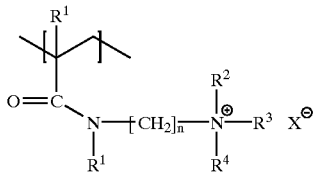

wherein $R^1$ is a hydrogen or a methyl group; $R^2$, $R^3$ and $R^4$ are linear or branched $C_1$–$C_4$ alkyl groups; n represents an integer from 1 to 4; and $X^-$ represents a counterion which is compatible with the water-soluble or water-dispersible nature of the polymer;

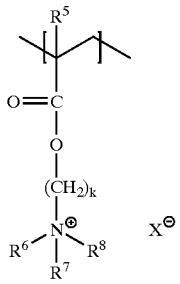

wherein $R^5$, $R^6$, $R^7$ and $R^8$ are independently H, or a $C_1$–$C_4$ alkyl group, k is an integer from 1 to 4; and $X^-$ represents a counterion which is compatible with the water-soluble or water-dispersible nature of the polymer; and

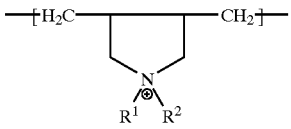

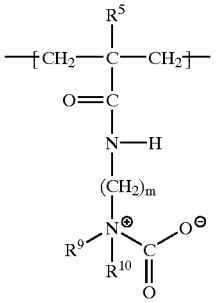

wherein $R^9$ and $R^{10}$ are independently H, or a $C_1$–$C_4$ alkyl group; and m is an integer from 1 to 4; and mixtures thereof;

provided that said suds enhancer has an average cationic charge density of 2.8 or less units per 100 daltons molecular weight at a pH of from about 4 to about 12;

b) an effective amount for removing soil and/or grease from the surface of dishware, of a detersive surfactant; and c) the balance carriers and other adjunct ingredients;

provided that a 10% aqueous solution of said detergent composition has a pH of from about 4 to about 12.

2. The composition according to claim 1 wherein said quaternary nitrogen-containing or zwitterionic polymeric suds enhancer (a) further comprises:

ii) one or more units having one or more hydroxyl groups, provided that said suds enhancer has a hydroxyl group density of 0.5 or less.

3. The composition according to claim 1 wherein said quaternary nitrogen-containing or zwitterionic polymeric suds enhancer (a) further comprises:

iii) one or more units having one or more hydrophobic groups selected from the group consisting of non-hydroxyl groups, non-cationic groups, non-anionic groups, non-carbonyl groups, and/or non-H-bonding groups.

4. The composition according to claim 1 wherein said quaternary nitrogen-containing or zwitterionic polymeric suds enhancer has an average cationic charge density of from about 0.01 to about 2.8 units per 100 daltons molecular weight at a pH of from about 4 to about 12.

5. The composition according to claim 4 wherein said quaternary nitrogen-containing or zwitterionic polymeric suds enhancer has an average cationic charge density of from about 0.1 to about 2.75 units per 100 daltons molecular weight at a pH of from about 4 to about 12.

6. The composition according to claim 5 wherein said quaternary nitrogen-containing or zwitterionic polymeric suds enhancer has an average cationic charge density of from 0.75 to about 2.25 units per 100 daltons molecular weight at a pH of from about 4 to about 12.

7. The composition according to claim 2 wherein said quaternary nitrogen-containing or zwitterionic polymeric suds enhancer has a hydroxyl group density of from about 0.000 1 to about 0.4.

8. The composition according to claim 1 wherein said quaternary nitrogen-containing or zwitterionic polymeric suds enhancer (a) further comprises a hydrophilic group-containing unit.

9. The composition according to claim 1 wherein said quaternary nitrogen-containing or zwitterionic polymeric suds enhancer (a) further comprises an anionic unit.

10. The composition according to claim 1 wherein said quaternary nitrogen-containing or zwitterionic polymeric suds enhancer (a) further comprises:

iv) units capable of having an anionic charge at a pH of from about 4 to about 12;

v) units capable of having an anionic charge and a cationic charge at a pH of from about 4 to about 12;

vi) units having no charge at a pH of from about 4 to about 12; and vii) mixtures of units (iv), (v), (vi), and (vii).

11. The composition according to claim 1 wherein said quaternary nitrogen-containing or zwitterionic polymeric suds stabilizer has an average molecular weight of from about 1,000 to about 2,000,000 daltons.

12. The composition according to claim 1 further comprising from about 0.25% to about 15% of a diamine having molecular weight less than or equal to 400 g/mol.

13. The composition according to claim 12 wherein said diamine is 1,3-bis(methylamine)-cyclohexane.

14. The composition according to claim 12 wherein said diamine has the formula:

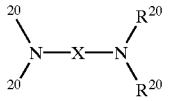

wherein each $R^{20}$ is independently selected from the group consisting of hydrogen, $C_1$–$C_4$ linear or branched alkyl, alkyleneoxy having the formula:

$$-(R^{21}O)_yR^{22}$$

wherein $R^{21}$ is $C_2$–$C_4$ linear or branched alkylene, and mixtures thereof; $R^{22}$ is hydrogen, $C_1$–$C_4$ alkyl, and mixtures thereof; y is from 1 to about 10; X is a unit selected from:

i) $C_3$–$C_{10}$ linear alkylene, $C_3$–$C_{10}$ branched alkylene, $C_3$–$C_{10}$ cyclic alkylene, $C_3$–$C_{10}$ branched cyclic alkylene, an alkyleneoxyalkylene having the formula:

$$-(R^{21}O)_yR^{21}$$

wherein $R^{21}$ and y are the same as defined herein above;

ii) $C_3$–$C_{10}$ linear, $C_3$–$C_{10}$ branched linear, $C_3$–$C_{10}$ cyclic, $C_3$–$C_{10}$ branched cyclic alkylene, $C_6$–$C_{10}$ arylene, wherein said unit comprises one or more electron donating or electron withdrawing moieties which provide said diamine with a $pK_a$ greater than about 8; and iii) mixtures of (i) and (ii)

provided said diamine has a $pK_a$ of at least about 8.

15. The composition according to claim 14 wherein each $R^{20}$ is hydrogen and X is $C_3$–$C_6$ linear alkylene, $C_3$–$C_6$ branched alkylene, and mixtures thereof.

16. The composition according to claim 1 wherein the detersive surfactant (b) is selected from the group consisting of linear alkyl benzene sulfonates, a-olefin sulfonates, paraffin sulfonates, methyl ester sulfonates, alkyl sulfates, alkyl alkoxy sulfates, alkyl sulfonates, alkyl alkoxy carboxylates, alkyl alkoxylated sulfates, sarcosinates, taurinates, and mixtures thereof.

17. The composition according to claim 1, wherein said other adjuncts ingredients (c) is selected from the group consisting of: soil release polymers, polymeric dispersants, polysaccharides, abrasives, bactericides, tarnish inhibitors, builders, enzymes, opacifiers, dyes, perfumes, thickeners, antioxidants, processing aids, suds boosters, buffers, antifungal or mildew control agents, insect repellants, anticorrosive aids, chelants and mixtures thereof.

18. The composition according to claim 1, wherein said detersive surfactant (b) is selected from the group consisting of amine oxides, polyhydroxy fatty acid amides, betaines, sulfobetaines, alkyl polyglycosides, alkyl ethoxylates, and mixtures thereof.

19. The composition according to claim 1, wherein said quaternary nitrogen-containing or zwitterionic polymeric suds stabilizer (a) is a proteinaceous suds enhancer.

20. The composition according to claim 1, further comprising an enzyme selected from the group consisting of protease, amylase, and mixtures thereof.

21. The composition according to claim 1, wherein said quaternary nitrogen-containing or zwitterionic polymeric suds stabilizer further comprises a cationic unit of the formula:

[I]

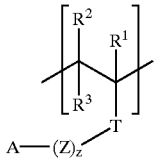

wherein each of $R^1$, $R^2$ and $R^3$ are independently selected from the group consisting of hydrogen, $C_1$ to $C_6$ alkyl, and mixtures thereof; T is selected from the group consisting of substituted or unsubstituted, saturated or unsaturated, linear or branched radicals selected from the group consisting of alkyl, cycloalkyl, aryl, alkaryl, aralkyl, heterocyclic ring, silyl, nitro, halo, cyano, sulfonato, alkoxy, keto, ester, ether, carbonyl, amido, amino, glycidyl, carbanato, carbamate, carboxylic, and carboalkoxy radicals and mixtures thereof; Z is selected from the group consisting of: $—(CH_2)—$, $(CH_2—CH=CH)—$, $—(CH_2—CHOH)—$, $(CH_2—CHNR^4)—$, $—(CH_2—CHR^5—O)—$ and mixtures thereof; $R^4$ and $R^5$ are selected from the group consisting of hydrogen, $C_1$ to $C_6$ alkyl and mixtures thereof; z is an integer selected from about 0 to about 12; A is $NR^6R^7$ or $NR^6R^7R^8$ wherein each of $R^6$, $R^7$ and $R^8$, when present, are independently selected from the group consisting of H, $C_1$–$C_8$ linear or branched alkyl, alkyleneoxy having the formula:

$$—(R^9O)_yR^{10}$$

wherein $R^9$ is $C_2$–$C_4$ linear or branched alkylene, and mixtures thereof; $R^{10}$ is hydrogen, $C_1$–$C_4$ alkyl, and mixtures thereof; and y is from 1 to about 10.

22. The composition according to claim 21, wherein said quaternary nitrogen-containing or zwitterionic polymeric suds enhancer (a) comprises a cationic unit of the formula selected from the group consisting of:

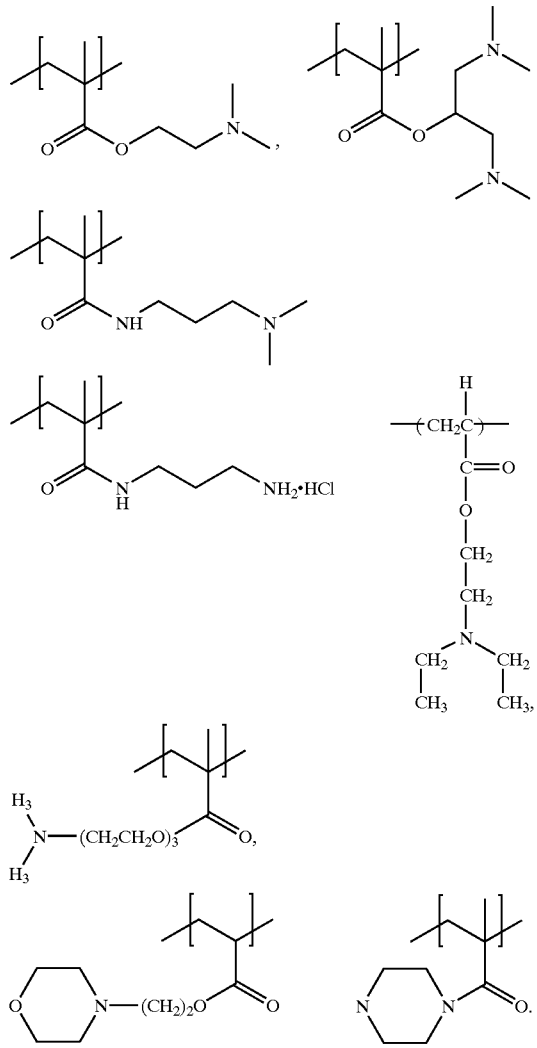

* * * * *

UNITED STATES PATENT AND TRADEMARK OFFICE

CERTIFICATE OF CORRECTION

PATENT NO. : 6,645,925 B2
DATED : November 11, 2003
INVENTOR(S) : Sivik et al.

It is certified that error appears in the above-identified patent and that said Letters Patent is hereby corrected as shown below:

Column 42,
Line 25, replace 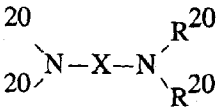 with 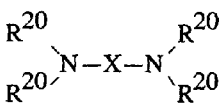

Signed and Sealed this

Fifth Day of October, 2004

JON W. DUDAS
*Director of the United States Patent and Trademark Office*